United States Patent [19]

Mollett et al.

[11] Patent Number: 4,724,158

[45] Date of Patent: Feb. 9, 1988

[54] TREATMENT OF ARCHIVAL MATERIAL

[75] Inventors: Christopher C. Mollett, Brighton; Christine E. Butler, Cheam; Michael L. Burstall, Guildford, all of England

[73] Assignee: The British Library, London, England

[21] Appl. No.: 708,620

[22] Filed: Mar. 5, 1985

[30] Foreign Application Priority Data

Mar. 5, 1984 [GB] United Kingdom ..... 8405717
Aug. 31, 1984 [GB] United Kingdom ..... 8422094

[51] Int. Cl.[4] ..... B05D 3/06
[52] U.S. Cl. ..... 427/44; 427/140
[58] Field of Search ..... 427/44, 140, 35, 36

[56] References Cited

U.S. PATENT DOCUMENTS

| | | | |
|---|---|---|---|
| 3,183,056 | 5/1965 | Pfeiffer | 8/116.2 |
| 3,522,158 | 7/1970 | Garnett et al. | 427/44 |
| 3,549,510 | 12/1970 | Casalina . | |
| 3,676,182 | 7/1972 | Smith . | |
| 3,698,925 | 10/1972 | Salz et al. | 427/140 |
| 3,721,579 | 3/1973 | Barrett | 427/44 |
| 3,726,709 | 4/1973 | Garratt et al. | 427/44 |
| 3,748,241 | 7/1973 | Garnett et al. . | |
| 3,912,837 | 10/1975 | Pesek et al. | 427/44 |
| 3,969,549 | 7/1976 | Williams et al. | 427/248 |
| 4,091,167 | 5/1978 | Okada et al. | 428/213 |
| 4,148,949 | 4/1979 | Casper et al. | 427/391 |
| 4,237,185 | 12/1980 | Lombardi et al. | 428/337 |
| 4,323,591 | 4/1982 | Wendling et al. | 427/53.1 |

FOREIGN PATENT DOCUMENTS

| | | |
|---|---|---|
| 527043 | 10/1940 | United Kingdom . |
| 572959 | 10/1945 | United Kingdom . |
| 572995 | 11/1945 | United Kingdom . |
| 607769 | 9/1948 | United Kingdom . |
| 1039444 | 8/1966 | United Kingdom . |
| 1069953 | 5/1967 | United Kingdom . |
| 1333865 | 10/1973 | United Kingdom . |
| 1338150 | 11/1973 | United Kingdom . |
| 1350668 | 4/1974 | United Kingdom . |
| 1596827 | 9/1981 | United Kingdom . |

OTHER PUBLICATIONS

Bull. Inst. Paper Chem.; 52; 2, Aug. 81, p. 141, abstract 1171.

Advances in Macromolecular Chemistry, 1970, vol. 2, pp. 1–88.

Tappi V45, No. 5, pp. 390–400 (1962).

*Primary Examiner*—John H. Newsome
*Attorney, Agent, or Firm*—Pennie & Edmonds

[57] ABSTRACT

A process for the treatment of archival material such as books and other bound volumes. The treatment includes a radiation-induced polymerization of at least one vinyl monomer within the paper of the archival material. The process, which is carried out in a substantially nonaqueous system, may be used to improve the structure of paper as well as to provide some protection against degradation of the paper.

47 Claims, 22 Drawing Figures

PURE COTTON SUBSTRATE TREATED WITH ETHYL ACRYLATE, 30% MONOMER ADDITION

PURE COTTON SUBSTRATE 3:2 BUTYL ACRYLATE+METHYL METHACRYLATE MIXTURE 35% MONOMER ADDITION

PURE COTTON SUBSTRATE, ETHYL ACRYLATE/METHANOL MIXTURE, 30 % MONOMER ADDITION

DEPENDENCE OF FOLD ENDURANCE ON PERCENTAGE WEIGHT GAIN FOR PURE COTTON PAPER (EA:MMA 5:1, 0·48 MRAD)

TREATMENT OF BOOK CROSS-SECTION (MECHANICAL): % WEIGHT GAIN PROFILE

DEPENDENCE OF % YIELD AND % WEIGHT GAIN ON MONOMER ADDITION TO PURE COTTON PAPER

DEPENDENCE OF YIELD ON WEIGHT FRACTION METHYL METHACRYLATE IN MONOMER CHARGE

% YIELD AS A FUNCTION OF TOTAL DOSE FOR TREATMENT OF PURE COTTON PAPER AND BULK POLYMERISATION

• TREATMENT OF PURE COTTON PAPER

∘ BULK POLYMERISATION

WEIGHT GAIN AS A FUNCTION OF RADIATION DOSE FOR PURE COTTON PAPER AND BOOK HH (MECHANICAL)

—— • PURE COTTON PAPER

---- ▪ BOOK HH

WEIGHT GAIN AND YIELD AS A FUNCTION OF RADIATION DOSE FOR ESPARTO SUBSTRATE (BOOK L)

WEIGHT GAIN AND YIELD AS A FUNCTION OF RADIATION DOSE FOR ESPARTO SUBSTRATE (BOOK L)

WEIGHT INCREASE AND YIELD AS A FUNCTION OF RADIATION DOSE FOR TREATMENT OF MECHANICAL SUBSTRATES WITH DIFFERENT MONOMER RATIOS

WEIGHT GAIN AND YIELD AS A FUNCTION OF RADIATION DOSE FOR AN ESPARTO SUBSTRATE WITH DIFFERENT COMONOMERS (BOOK L)

DEPENDENCE OF % WEIGHT INCREASE AND YIELD ON TOTAL DOSE FOR THE TREATMENT OF PURE COTTON PAPER

• DOSE RATE 0·3 MRAD $HR^{-1}$

▾ DOSE RATE 0·03 MRAD $HR^{-1}$

DEPENDENCE OF WEIGHT INCREASE AND YIELD ON TOTAL DOSE FOR ESPARTO BASED PAPER

DOSE RATE 0·3 MRAD/HR

• EA:MMA 5:1

∘ EA:MMA 7:3

DOSE RATE 0·03 MRAD/HR

▿ EA:MMA 5:1

▾ EA:MMA 7:3

WEIGHT INCREASE AS A FUNCTION OF TIME FOR TREATMENT OF AGED MECHANICAL SUBSTRATE

WEIGHT INCREASE AS A FUNCTION OF RADIATION DOSE FOR BOOK E

WEIGHT INCREASE AS A FUNCTION OF RADIATION DOSE FOR BOOK 7A WITH EA:MMA MIXTURES

TREATMENT OF ARCHIVAL MATERIAL

This invention relates to the treatment of archival material, more especially books and other bound volumes.

The paper of such materials is mainly composed of cellulose fibres and, depending on its origin, it also contains variable amounts of hemicelluloses and lignins. The deterioration of these papers on prolonged storage has been known for a considerable time and there is little doubt that a major cause of deterioration is the hydrolysis of the cellulose, catalysed by acid present within the substrate. These acids may arise in a variety of ways:

(1) As a by-product of rosin-alum sizing; as the salt of a weak base and a strong acid, alum has a strongly acidic reaction.

(2) By the conversion of atmospheric pollutants to strong acids, sulphuric acid formed from sulphur dioxide being the most important.

(3) From the degradation of lignin: in the presence of light and oxygen, lignin is oxidized to give, inter alia, organic acids which may catalyse the hydrolysis reaction.

(4) From the oxidation of celluloses and hemicelluloses during bleaching and other papermaking operations, or on storage.

The rate of hydrolysis depends on various factors, including the natrue of the cellulose and the conditions under which the peper is stored. Under most conditions, however, most papers deteriorate progressively. The fibre scission leads to loss of strength, and the papers become brittle and often discoloured. Ligninrich woody papers suffer particularly badly. Deterioration of archival material, much of which is rich in lignin, is a familiar and severe problem to librarians.

Methods of arresting and of reversing the effects of this process are therefore desirable.

Previous approaches have concentrated on the restoration of pH levels within the substrate to neutral or alkaline, with additional buffering capacity to protect against further attack.

The most widely used process, developed by Barrow, comprises deacidification of the substrate with precipitation of a residual buffering compound. Substrates are immersed in a solution of calcium hydroxide, neutralising any acid present, are drained and then immersed in a second solution of calcium bicarbonate. Residual calcium hydroxide is converted to calcium carbonate by calcium bicarbonate. On drying of the sheet, the calcium bicarbonate reverts to calcium carbonate, providing an effective buffer for a limited period against the effects of further exposure to acid. Another treatment involves impregnating the book paper with an aqueous solution of magnesium bicarbonate. Whilst such treatments undoubtedly confer stability to the paper with respect to acid degradation, they are, however, inherently unsuitable for large-scale application since it is necessary to debind the books, treat each sheet individually and then rebind the dried buffered pages.

For bulk treatment of books, there are two main methods currently available. Book depend exclusively on deacidification with deposition of residual buffer compound to provide further protection. One method is a liquid or spray application, whilst the other employs vapour-phase treatments.

In the liquid-phase method, the books are immersed in a solution of magnesium methoxide in methanol and liquified freon maintained under a positive pressure. After saturation, residual solvent is removed under vacuum leaving the magnesium compound in the books. However, water must be removed from the substrate (to a final content $<0.5\%$ by weight) before treatment commences, which adds considerably to the time and cost of the process, and, being a liquid-phase process, there is a possibility of ink migration due to solubility in the solvents and of chemical migration during drying.

In the vapour-phase method, books are exposed at reduced pressure, after careful drying, to diethyl zinc vapour at 45° C. The treated samples are thus both neutralised and buffered, with residual diethyl zinc being converted to zinc carbonate. The process is suitable for all types of books and can be carried out on large numbers of books at a time. No dimensional changes occur to the substrate. However, diethyl zinc is a potential fire hazard and, also, its use may give rise to toxicity problems. Moreover, since the water-diethyl zinc reaction is violent, the process requires complete dewatering of the paper, and this is generally undesirable. There is also some risk of photosensitisation and hence discolouration of the paper. Furthermore, the temperature is somewhat high, which is potentially damaging to the paper, ink and adhesives.

A different treatment, using volatile bases such as morpholine, has produced little success. Whilst the pH rises initially to values as high as 8.0, it falls rapidly to acid pH again, indicating that the substrate would have to be retreated every few years to maintain protection. In addition, the amines may also cause significant discolouration of papers, depending on the amine and the paper type. Some of the amines used also present problems of toxicity.

A further method, but one which can be used on individual sheets only, involves providing each sheet with a support system, for example by lamination or encapsulation with plastic, which increases bulk.

There is therefore a need for a preservation process for archival material which avoids or substantially avoids the above problems.

In practical terms, a satisfactory treatment procedure should have the following characteristics:

(a) it should impart resistance to further deterioration;

(b) it should restore, or at least improve, the mechanical properties of the damaged papers;

(c) there should be negligible change in sheet dimensions, including thickness;

(d) the process should ideally be applicable to all types of fibre and paper compositions;

(e) the process should be suitable for routine application to large batches of books with minimum pretreatment, i.e., no debinding of books should be necessary;

(f) no observable damage to the print, binding or cover is acceptable;

(g) the treated material should ideally have minimal discolouration and should not have noticeably different surface texture;

(h) the reagents used should present no hazards to those operating the process or to subsequent users of the treated materials.

We have found that it is possible to retard degradation and restore the strength of the paper comprising the archival material by protecting the individual fibres within the substrate with a polymer prepared in situ and initiated by high energy radiation.

The present invention provides a process for the treatment of archival material, which comprises the radiation-induced polymerisation, within the paper, of a vinyl monomer or a monomer mixture comprising one or more vinyl monomers, irradiation being carried out in the presence of the monomer or monomers, and the process being carried out in a substantially nonaqueous system.

Acrylates and methacrylates, more especially ethyl acrylate, have been found to be amongst the most suitable monomers, and can be condensed within the substrate from the vapour phase and polymerised with an acceptable dose of radiation (e.g. 0.4 or 0.48 MRad) under mild reaction conditions.

A mutual irradiation technique is used, that is, the irradiation is carried out in the presence of the monomer. Surprisingly, we have obtained substantially homogeneous deposition of the polymer: deposition is substantially uniform within each single paper sheet and over entire books. In contrast, if monomer is added after irradiation, polymerisation occurs only at active sites and a non-homogeneous result is obtained.

A substantially non-aqueous system is used: thus there is no swelling, or only minimal swelling, of the fibres.

Using the process of the present invention, good results can be obtained, both in terms of increased resistance to subsequent degradation by our test substance, aqueous sulphuric acid, and increased fold endurance (a measurement which we believe correlates with the results of general wear and tear). In fact significant increases in fold endurance have been obtained with a weight increase of the sheet of only about 20–25% based on fibre weight.

The process may be applied to modern and aged material.

The process is suitable for bound volumes, and batches of books can be treated together. Indeed, the ability to treat complete books without debinding, and, further, to treat batches of books and manuscripts without the need for complete prior categorisation and segregation, which would be expensive and timeconsuming, is of crucial significance to any preservation process. Thus, book bindings and covers must be capable of treatment with the rest of the book, and books of different ages and reactivities should ideally be capable of treatment together, without excessive deposition of polymer in the most reactive substrates at the expense of less active materials. Possible reduced polymer deposition in the unreactive substrates is not perhaps so important, since failure of reaction will not cause significant damage, but prevention of excessive deposition in the more reactive papers is crucial, since this could cause translucency and changes in the feel of the paper: in some cases bonding of pages together could even occur. However, we have found that, surprisingly, these disadvantages do not occur with the process of the present invention.

Other processes involving polymerisation to cellulose materials, including paper, have been described, but none of these discloses treating archival material (or indeed is suitable for such treatment). Thus, K. Ward, Chemical Modification of Papermaking Fibers, 1973, Marcel Dekker Inc., New York, Chapter 6, gives a general review of polymerisation treatments on cellulose, but does not touch on the problem of books. U.S. Pat. No. 3,183,056 describes polymerisation using an aqueous system and a peroxygen initiator. The process is diffusion controlled, leading to dimensional changes in the substrate and a non-homogeneous product. Great Britain patent Specification Nos. 572959 and 572995 also describe polymerisation in an aqueous solution, not suitable for books.

A radiation polymerisation process for treating sheet material is also described in U.S. Pat. No. 3,549,510. The sheets are impregnated with liquid monomer and polymerised by subjecting them to ionising radiation to form a continuous flexible layer of polymer at the surface of the sheet. The substrates are treated individually. In the process described, fibre board is placed in a plastic bag and saturated with a monomer mixture containing carbon tetrachloride, excess liquid is poured out and the bag is then irradiated at a dose of 3 MRad. The process is used to give increased strength to porous material such as single-ply or corrugated board used, for example, for boxes. It is not concerned with the treatment of paper, and the use of high radiation doses would in fact make the process unsuitable for such treatment. Saturation of the substrate would lead to massive weight gain and hence to a change in sheet thickness (and also to subsequent collapse of shelving), to deposition of the material between the sheets, resulting in adherence of the sheets to one another and in fact to a solid block of material, and furthermore would lead to damage to adhesives and book covers.

In contrast, by the process of the present invention, we have surprisingly obtained a negligible change in sheet thickness, no damage to the print and to the covers or bindings. The latter is very surprising since, whether the monomer is introduced in the vapour phase or liquid phase, the polymerisation reaction itself occurs in the liquid phase and liquid monomer is capable of weakening some binding adhesives.

Solvent extraction of archival material treated by the process of the present invention reveals that the polymer is inextricably linked with the fibre matrix. Although this is not conclusive proof of grafting of polymer to matrix, it is generally considered that resistance to solvent extraction, coupled with improvement in the substrate's physical properties, is strong evidence in favour of grafting.

Examination using visible and electron microscopy (see, for example, FIGS. 1A and 1B) shows that polymer is deposited within the substrate: throughout the fibre and also between the fibres, producing interfibre linking; this probably accounts for both increased chemical resistance and fold endurance. The voids in the fibre matrix were not completely filled with polymer. In contrast, microscopic examination of archival material treated by a corresponding solution polymerisation process (see FIG. 1C) showed that in such instances polymer is generally deposited in discrete particles on the surface of the fibres and within the fibre; no interfibre linking was seen and this process did not produce satisfactory improvement in fold endurance.

Suitable monomers for use in a process of the present invention are, for example, those of the general formula $$CH_2{=}CR^{\bullet}{-}COOR$$

in which $R^{\bullet}$ represents a hydrogen atom or a lower alkyl radical, e.g. ethyl or, preferably, methyl, and R represents (i) a group of the general formula $$C_nH_{2n+1} \text{ or } C_nH_{2n}X$$

in which n represents an integer from 1 to 16, and

X represents OH, a halogen atom or an unsubstituted or mono- or di-lower alkylsubstituted amino group, or (ii) a group of the general formula $$-CH_2C_mH_{2m-1} \text{ or } -CH_2C_mH_{2m-3}$$

in which m represents an integer from 2 to 15, or (iii) a group of the general formula $$-C_{n^\bullet}H_{2n^\bullet}-Y$$

where n• represents 0 or an integer from 1 to 16 and

Y represents a phenyl group or a ($C_5$–$C_7$)cycloalkyl radical, each of which is unsubstituted or substituted by one or more alkyl radicals having up to 16 carbon atoms in the alkyl moiety or moieties, e.g. benzyl, phenyl, tolyl or cyclohexyl.

A $C_nH_{2n+1}$, $C_nH_{2n}$, $C_mH_{2m-1}$, $C_mH_{2m-3}$ or $C_{n^\bullet}H_{2n^\bullet}$ radical or a lower alkyl radical or an alkyl radical in a group represented by Y may be a straight or branched chain group.

The hydroxy group or amino radical in a $C_nH_{2n}X$ radical is preferably in the ω-position.

A halogen atom represented by X is especially a fluorine, chlorine or bromine atom.

It should be understood that the term "lower" used herein in connection with lower alkyl radicals represented for example by R• or in a radical represented by R denotes such groups that have from 1 to 4 carbon atoms. Preferably, in a $C_nH_{2n+1}$, $C_nH_{2n}X$, $CH_2C_mH_{2m-1}$ or $CH_2C_mH_{2m-3}$ radical there is a maximum of 8 carbon atoms, and in a $C_{n^\bullet}H_{2n^\bullet}$ radical or an alkyl substituent of Y there is preferably a maximum of 4 carbon atoms.

The monomer component may comprise a single monomer or two or more monomers which may, if desired, be mixed prior to treatment of the substrate, but this is not essential.

Factors which determine monomer selection include (a) ultimate sheet strength, as measured by fold endurance, and (b) polymer yield.

As regards fold endurance, we have found that brittle polymers, e.g. polymers of methyl methacrylate or vinylidene chloride, tend to produce little or no increase in fold endurance.

We have found that fold endurance values are related to the glass transition temperatures, ($T_g$), in the manner shown in FIG. 2. The glass transition temperature is a measure of the flexibility of the polymer, and it might be imagined that the more flexible the polymer, the better the fold endurance, but, surprisingly, the graph shows a peak in fold endurance. We have found that a value of $T_g$ in the range of from +20° to −20° C., more especially 0° to −10° C., gives good increases in sheet strength.

As regards yield, it should be noted that the phenolic structure of lignin and similar wood components can inhibit the radiation-induced free-radical polymerisation of most common monomers. Some inhibition of polymerisation might therefore be expected in our system when lignin-containing papers are treated, and an inhibition mechanism involving phenolic residues and molecular oxygen is possible. We have, in fact, found that when ethyl acrylate is used as the sole monomer different yields are obtained with different papers in the sequence:

Modern cotton > modern mechanical > aged cotton > aged news.

When yields are reduced there is a concurrent increase in polymer deposition on the wall of the reaction vessel, suggesting that the rate of polymerisation of monomer on the reactor surface and in the vapour is substantially greater than that in the paper. The impregnated substrate then merely acts as a reservoir of monomer rather than the locus of reaction itself.

One possibility we have considered is that the lower yields might be due, at least in part, to the presence of phenolic inhibitor in the monomer which is carried over when the monomer is distilled into the reaction vessel. However, alkali-washing of the monomer to remove phenolic inhibitors prior to distillation produced no discernible difference in either the reaction rate or the final yield of polymer. Moreover, the aged rag papers do not contain phenolic residues and any inhibition in those cases would require a different explanation, e.g. the action of oxygen alone.

Examination of the literature has not yielded any relevant information concerning possible changes that occur in cellulose over extended periods of exposure to the atmosphere. Indeed, there has been no previous work at all on grafting to aged substrates.

Some workers, dealing with substrates other than paper, have suggested that in polymerisation systems where oxygen is thought to cause problems in polymerisation, improved yields could be obtained by degassing of the substrate to remove the oxygen. According to this technique the vessel is repeatedly evacuated and brought to pressure with nitrogen. However, we have found that such techniques produce only marginal improvement with aged paper and modern mechanical paper substrates.

We have found that with these papers improved yields can be obtained when the process of adding monomer (e.g. ethyl acrylate) and irradiating was repeated and also when combinations of different monomers are used: a synergistic effect is observable. For example, small quantities of methyl methacrylate added to the ethyl acrylate proved especially useful. The addition of, for example, butyl methacrylate to ethyl acrylate also resulted in a substantial increase in polymer yield and large increases in yield were also obtained, for example, with mixtures of methyl acrylate and methyl or butyl methacrylate. The increase in yield with aged papers cannot be accounted for simply by independent polymerisation of the second monomer: the yield improvement so obtained is in excess of that which could be obtained from the addition of the methacrylate component alone. Concurrent with this increase is a reduction in the amount of polymeric material deposited on the reaction vessel walls. The evidence suggests that some synergistic effect is in operation.

The mechanism for this has not been fully elucidated, although we believe that the yield enhancement occurs when the effect of an inhibitor is suppressed. Certainly, achievement of success by repeating the treatment process on samples which failed the first time suggests that an inhibitor/retarder compound is present, which can be exhausted. Surface effects may be important, but we suspect that the inhibitor may be oxygen somehow "trapped" in the substrate. However, the mechanism by which monomer mixtures such as ethyl acrylate and methyl methacrylate might suppress the effectiveness of an inhibitor such as oxygen is still not fully proven.

Thus, preferably, in the process of the present invention inhibiting action of oxygen and/or other substance in and/or on the paper is reduced by chemical means, preferably such that the increase in weight of the substrate corresponds to a polymerisation yield of at least 60 %.

Especially, the present invention provides a process for the treatment of archival material, which comprises the radiation-induced polymerisation of a vinyl monomer within the paper in the presence of a minor amount of a yield-enhancing vinyl monomer, irradiation being carried out in the presence of the monomers and the process being carried out in a substantially non-aqueous system.

When this yield-enhancing monomer is co-used:

(I) the major component may comprise, for example, ethyl acrylate or related monomer of the general formula $$CH_2{=}CH{-}COOR'$$

where R' represents a group of the general formula $C_{n'}H_{2n'+1}$ or $C_{n'}H_{2n'}OH$ in which n' represents an integer from 1 to 10, preferably from 2 to 10, and more especially R' represents a ($C_2$–$C_8$)-alkyl radical, or represents phenyl; and (II) the minor component, which acts as yield enhancer, may comprise, for example, methyl methacrylate or related monomer of the general formula $$CH_2{=}CR^2{-}COOR''$$

in which

R'' represents (i) a group of the general formula $$C_nH_{2n+1} \text{ or } C_nH_{2n}X$$

preferably a ($C_1$–$C_8$)-alkyl radical, or (ii) a group of the general formula $$-CH_2C_mH_{2m-1} \text{ or } -CH_2C_mH_{2m-3}$$

in which n, X and m have the meanings given above, and $R_2$ represents a lower alkyl radical, e.g. ethyl or, preferably, methyl.

Examples of these compounds are

Acrylates: methyl, ethyl, propyl, isopropyl, butyl, amyl, hexyl, heptyl, isobutyl, s-butyl, t-butyl, 2-methyl-1-butyl, 3-methyl-1butyl, 3-pentyl, 2-methyl-1-pentyl, neopentyl, 2-ethyl-1-butyl, 4-methyl-2-pentyl, 2heptyl, 2-ethylhexyl, 2-hydroxyethyl and phenyl Methacrylates: methyl, ethyl, butyl, cyclohexyl, 2-hydroxyethyl, allyl, and 2-(dimethylamino)-ethyl.

Successful combinations of major and minor monomer components include, for example, methyl acrylate and methyl methacrylate
ethyl acrylate and methyl methacrylate
butyl acrylate and methyl methacrylate
2-ethylhexyl acrylate and methyl methacrylate
ethyl acrylate and ethyl methacrylate
methyl acrylate and butyl methacrylate
ethyl acrylate and butyl methacrylate.

The present invention more especially provides a process for the treatment of archival material, which comprises radiation-induced polymerisation of ethyl acrylate monomer within the paper in the presence of methyl methacrylate, irradiation being carried out in the presence of the two monomers and the process being carried out in a substantially non-aqueous system.

It should of course be understood that although we have referred only to the polymerisation of the ethyl acrylate component, since methyl methacrylate is also present some of this is probably also incorporated in the resulting polymer; we use the term "polymer" herein to include copolymers as well as homopolymers.

The polymer yield must, however, be balanced with optimising increase in fold endurance of the treated sheets. As explained above, this is related to the glass transition temperature, $T_g$. When a mixture of monomers A and B is used, $T_g$ is approximately given by:

$$\frac{100}{T_g(A+B)} = \frac{\%\text{ component } A}{T_gA} + \frac{\%\text{ component } B}{T_gB} \text{ or}$$

$$T_g(A+B) = \frac{100(T_gA)(T_gB)}{(\%\text{ component } B)(T_gA) + (\%\text{ component } A)(T_gB)}$$

where the $T_g$ values are in degree kelvin Absolute.

Thus for a mixture of monomers, the relative proportions that may be used are influenced by the glass transition temperatures of each homopolymer. For example, poly(ethyl acrylate) has a glass transition temperature of −22° C.; poly(methyl methacrylate) of 105° C.; for a polymer prepared from a mixture of 83% by weight ethyl acrylate and 17% by weight methyl methacrylate (approx. 5:1 mixture by weight) the glass transition temperature is −7° C. These two monomers may be used, for example, in a weight ratio of ethyl acrylate to methyl methacrylate of from 20:1 to 1:1, preferably from 3:1 to 5:1, more especially 5:1.

Another highly effective means for improving yield comprises application of monomer and irradiation, after which application of further monomer and further irradiation brings about the substantive protective polymerisation reaction.

Accordingly, the present invention also especially provides a process for the treatment of archival material, which comprises the radiation-induced polymerisation, within the paper, of a vinyl monomer or a monomer mixture comprising one or more vinyl monomers, wherein repeated treatment is used, irradiation being carried out after the addition of the monomer or monomers in each case, and the process being carried out in a substantially non-aqueous system.

The further monomer may be the same or a different monomer; for example ethyl acrylate may be used in each step. The amount of monomer added in the first step may be, for example, the same as in the second step or, in many instances, less; for example ≦20% by weight of the total monomer addition may be made in the first step.

Accordingly, the present invention also more especially provides a process for the treatment of archival material, which comprises the radiation-induced polymerisation of ethyl acrylate monomer within the paper using repeated treatment, irradiation being carried out after addition of ethyl acrylate in each case, and the process being carried out in a substantially non-aqueous system.

Processes of the present invention in which the monomer or monomers are condensed within the substrate from the vapour phase should especially be mentioned. For this, the monomer or monomers selected must have sufficiently low boiling points enabling transfer to the documents from the vapour phase. Monomers with boiling points no more than about 130° C., especially ≦110° C., at atmospheric pressure, may be mentioned. Preferably, however, for this method the boiling point should be substantially less.

Some of the monomers mentioned above, for example butyl acrylate, isobutyl acrylate, 2-ethylhexyl acrylate, 2-ethoxyethyl acrylate, butyl methacrylate, isobutyl, hexyl and lauryl methacrylate, and longer-chain acrylates and methacrylates have too high a boiling point for the vapour-phase process.

We have carried out the monomer addition successfully, not only as a vapour-phase treatment, but also as a liquid-phase treatment. In both methods the polymerisation reaction occurs in the liquid phase on the substrate, and it is important to ensure homogeneity of the monomer or monomers on the substrate. Where individual sheets, for example maps, are to be treated, it may be simpler to use a liquid-phase treatment, for example by squirting the monomer on to the substrate, and then use mechanical means, for example rotation of the vessel, to ensure homogeneity before irradiation. Where very many separate substrates or an entire book or books are to be treated, a vapour-phase treatment, in which the monomer(s) are transported to the substrate in the vapour phase and then condensed on the substrate prior to irradiation, may be more suitable for ensuring homogeneity. In both cases, to ensure really good homogeneity during reaction, it may be desirable to rotate the vessel.

By introducing the monomer or monomers in the liquid phase it is possible to employ monomers with higher boiling points such, for example, as 2-ethylhexyl acrylate, which has a boiling point of ~230° C. We have found polymerisation of a high boiling monomer alone gave excellent polymer yields. Since, we believe, reduced polymerisation yields on the substrate are a result of competition between polymerisation reactions in the substrate and out of it, the increased yield with high boiling monomers can probably be attributed to the fact that the vapour pressure of the monomer (which is a function of the boiling point) is sufficiently low that there is considerably reduced transfer of monomer from the substrate into the atmosphere of the vessel and correspondingly reduced polymerisation in the atmosphere and on the vessel wall.

We have also observed that with decreased temperature in the reaction vessel, for a given substrate and monomer or monomer mixture, the yield of polymer increases, (although reaction times will be increased). This can probably also be attributed to the low vapour pressure of the monomer(s).

Similarly, increase of the pressure of reaction could so affect the vapour pressure of the monomer(s) that the presence of inhibitor in the substrate becomes unimportant.

Accordingly, the present invention especially provides a process for the treatment of archival material, which comprises the radiation-induced polymerisation, within the paper, of a vinyl monomer or a monomer mixture comprising one or more vinyl monomers, irradiation being carried out in the presence of the monomer or monomer mixture and the process being carried out in a substantially non-aqueous system, the vapour pressure of the monomer or monomer mixture at the temperature and pressure of the reaction being such that there is no significant transfer of monomer from the paper.

The vapour pressure of the monomer or monomer mixture that will give any pre-determined yield (for example ≧55 %) according to this embodiment will depend on the substrate and can easily be determined by experiment. FIG. 3 illustrates the dependence of yield on monomer vapour pressure for different substrates. Consideration of the yields given by polymerising each of ethyl acrylate, butyl acrylate and 2-ethylhexyl acrylate on their own on a pure cotton substrate and on an aged substrate shows that for both substrates with these monomers there is an increase in yield as monomer vapour pressure decreases. The required vapour pressure likely to produce a given yield (e.g. ≧55% or ≧60%) on this particular substrate for this series of compounds, the alkyl acrylates, can easily be determined from this plot.

Accordingly, the present invention provides a process for the treatment of archival material, which comprises the radiation-induced polymerisation, within the paper, of a vinyl monomer or a monomer mixture comprising one or more vinyl monomers, irradiation being carried out in the presence of the monomer or monomers, and the process being carried out in a substantially non-aqueous system, the vapour pressure of the monomer or monomer mixture at the temperature and pressure of the reaction being such that the increase in weight of the paper corresponds to a polymerisation yield of at least 60%.

Where normal temperature and pressure are used for the reaction, and a single monomer is used with no repeat of the process, the monomer preferably should have a boiling point of ≧130° C., more especially ≧150° C., at atmospheric pressure.

The present invention especially provides a process for the treatment of archival material, which comprises radiation-induced polymerisation, within the paper, of a vinyl monomer or a monomer mixture comprising one or more vinyl monomers, irradiation being carried out in the presence of the monomer or monomers, and the monomer or monomer mixture having a boiling point of at least 130° C. at atmospheric pressure and being introduced in the liquid phase, the process being carried out in a substantially non-aqueous system.

Other methods of increasing the efficiency of polymer deposition include:

(a) addition of a non-polymerisable compound as scavenger of inhibitor;

(b) addition of a substance to increase the rate of initiation, for example chloroform or carbon tetrachloride;

(c) chemical conversion of the inhibitor.

Impregnation of sample sheets of aged paper with tetrakis(hydroxymethyl)phosphonium chloride (THPC) (which is a compound which reacts with oxygen) produces a significant increase in polymer yield. Moreover, the polymer yield is dependent upon the concentration of THPC present.

The addition of chloroform or carbon tetrachloride (~5 % by weight on a.d. (i.e. air dried) fibre) which are also solvents for ethyl acrylate and swelling agents for the polymer, would also give significantly increased polymer yields. However, whilst this method is effective with mechanical paper substrates, it is not apparently applicable to all substrates, aged rag and aged esparto being particularly unresponsive. Moreover, the process of the present invention should be carried out in a substantially solvent-free system and/or such that there is a minimum swelling of the fibers.

Pre-irradiation prior to impregnation with monomer, particularly in the presence of chloroform or carbon tetrachloride, and subsequent reirradiation, has produced up to a 3-fold increase in yield. (If inhibition is due to oxygen, pre-irradiation should convert this to cellulose-peroxides.) The effectiveness of the treatment increases with increasing dose. However, this treatment was, carried out by degassing the substrate, preirradiating in the presence of chloroform (for example 5% by weight chloroform +0.4 to 0.48 MRad), impregnation with monomer followed by a second irradiation step (for example 0.15 to 0.2 MRad), and while yields were attractively increased, the process has two major disadvantages, namely the use of chloroform and the two-step irradiation procedure.

For improving the efficiency of polymer deposition, one or more of the various means described above may be used, provided there is no substantial use of solvent or there is minimum swelling of the fibres.

Removal of inhibitor by physical means such as degassing may also be used, but produces marginal improvement in polymer yield. Extraction of aged samples with particular solvents (e.g. degassed methanol) and subsequent irradiation after impregnation with monomer may give increased yields in some instances, but should not be carried out on the archivable material.

However, preferably, polymer yield in the treatment of aged samples may be significantly increased by the use of methyl methacrylate or other comonomer. The reason has not been clearly shown, but preferential reaction with inhibiting oxygen is a possibility. If this is the case and the amount of contaminating oxygen is low, then an important requirement in the reaction vessel is, we believe, the presence of a co-monomer such that the polymerisation of monomer within the sheet will dominate the competing reaction in the vapour and on the sides of the reaction vessel wall. (We believe that oxygen slows down the bulk reaction in the substrate, thus adversely affecting the ratio of polymerisation in the substrate to polymerisation on the vessel wall.)

The deposition of acid-resistant polymer by the process of the present invention has been shown to provide resistance to attack by acid solutions, including resistance to internal attack by acid already present.

The inclusion of a basic monomer in the polymerisation step may be useful in providing, if required, additional resistance to internal attack. Amine-substituted alkyl methacrylate monomers, for example, are suitable, more especially 2-(dimethylamino)ethyl methacrylate. The amine monomer is readily polymerised by γ-radiation, and it is a sufficiently strong base that little needs to be incorporated in the monomer charge to effect complete neutralisation. Paper samples impregnated with acid to a pH of 4.0 have been adequately treated with a monomer mixture of ethyl acrylate:methyl methacrylate:amino-substituted monomer of 5:1:0.1 by weight, yielding 15% polymer and a resulting alkaline substrate. Strength improvements are not impaired at this level of amine addition.

Other monomers which might be used include: acrylonitrile, acrylamide and vinyl pyridine. Acrylonitrile and acrylamide are toxic, however, and acrylamide has the further disadvantage that it is a solid and cannot be introduced from the vapour phase.

As stated previously, vinylidene chloride gives brittle polymers, lacking in strength; it does however impart good acid resistance and so may be useful in combination with other monomer(s). Similarly, vinyl chloride would present problems if used on its own, as its homopolymer is unstable, the by-product of its "unzipping" being HCl.

For book consolidation strength gain is important and therefore highly non-polar monomers such as styrene, isoprene and butadiene are to be avoided or used only in small quantities; these appear to have poor compatibility with the cellulose itself.

We have found that both isoprene and vinylidene chloride tend to disrupt any existing fibre-fibre bonding.

The temperature selected for the process is influenced by the material treated. To avoid damage to book bindings the upper limit should generally be 40°-50° C. Similarly, although temperatures as low as minus 90° C. have been used for polymerisation, in practice temperatures low enough to freeze the water in any binding should be avoided. Moreover, at such low temperatures the homogeneity of the product is very poor and there is some surface deposition on the paper. Thus, the process may be carried out for example at a temperature in the range of from 5° to 50° C., preferably no more than 40° C., more especially at ambient temperature.

Pressure is generally atmospheric pressure but elevated or reduced pressure are possible.

However, as mentioned above, the pressure and temperature selected can influence yield, and this factor may have a strong influence on the choice of conditions used. Thus, to improve yield, the reaction may be carried out at reduced temperature or elevated pressure although, in the latter case, in order to assist the transfer of monomer into the substrate, a lower pressure, e.g. reduced or atmospheric pressure, may be used during introduction of the monomer.

γ-rays are suitably used as initiator, although X-rays may also be possible; suitable radiation doses for the or each irradiation step are, for example, in the range of from 0.1 to 1.0 MRad, preferably at least 0.2 MRad, more especially 0.4 to 0.48 MRad. The top limit is chosen to avoid damage to the substrate. Where the process is repeated, the same or different dose may be used in the two steps; satisfactory yields have been obtained with, for example, 0.4 to 0.48 MRad in the first step and a lower dose in the second step.

Using the mixed monomer method, we have found that for the same total dose of radiation and approximately the same polymer addition, increases in fold endurance for aged substrates treated with polymer at two different dose rates (0.03 and 0.3 MRad $hr^{-1}$) were greater with the higher radiation dose rate.

The total monomer addition is, for example, from 15 to 50%, preferably 25 to 35%, more especially 30%, of the fibre weight. Especially, there should be mentioned the use of 15 to 50%, preferably 15 to 25%, more especially 20% or 30%, of the weight of the archival material.

Increases in weight of the paper comprising the archival material due to polymer deposition of for example from 5 to 40%, especially 10 to 40%, preferably 15 to 25%, more especially 20%, have been achieved and given good results.

FIG. 4 illustrates the relationship of fold endurance to percentage weight increase for a pure cotton paper treated by a process of the present invention. As will be seen, substantial improvements in strength of some 45 fold (to give a fold endurance of approximately 2,000) were obtained with as little as 15% polymer, calculated on the weight of the paper, and 20 fold (to give a fold endurance of approximately 1,000) with a weight increase of only 10%. In some cases increases in fold endurance of up to 150 times have been obtained with as little as 20% polymer.

Sheet strength improvements are less marked with aged and woody papers but, providing that degradation is not too extensive, are, nevertheless, substantial.

The polymerisation of monomer mixtures, especially ethyl acrylate/methyl methacrylate mixtures, according to the invention will now be illustrated further, by way of example only, with reference to the accompanying FIGS. 5 to 18 in which.

Figure 10:
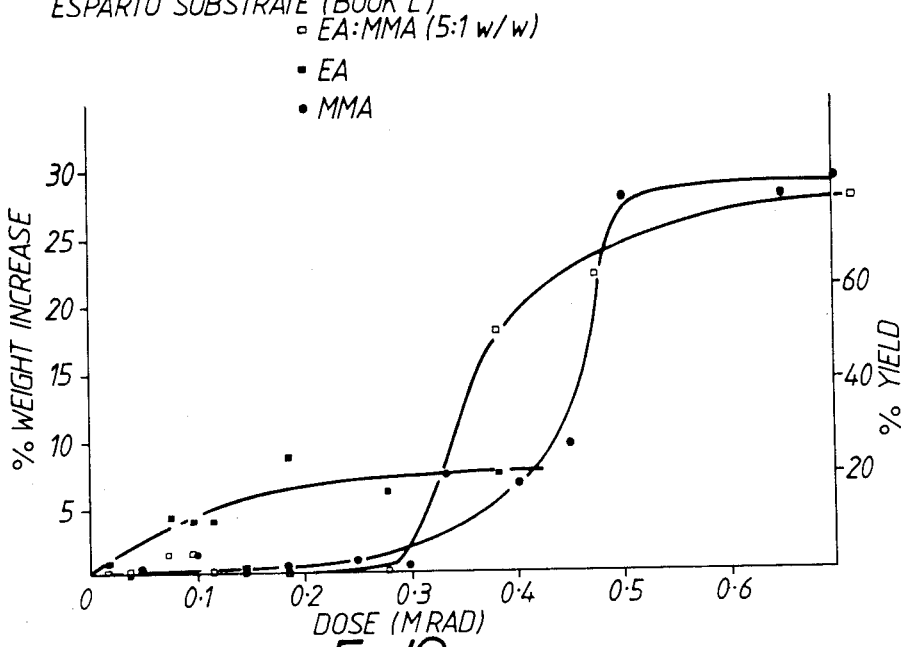
Figure 12:
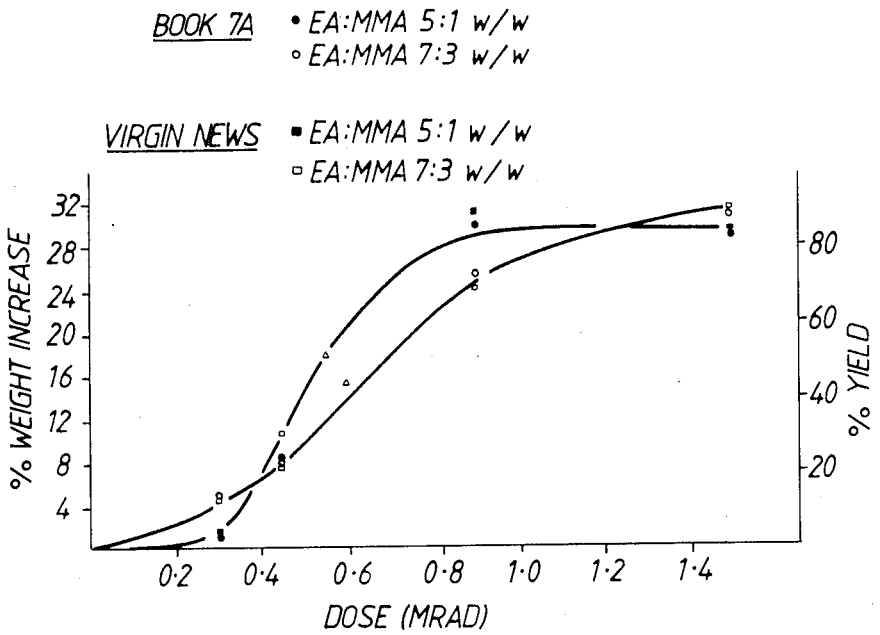
Figure 13:
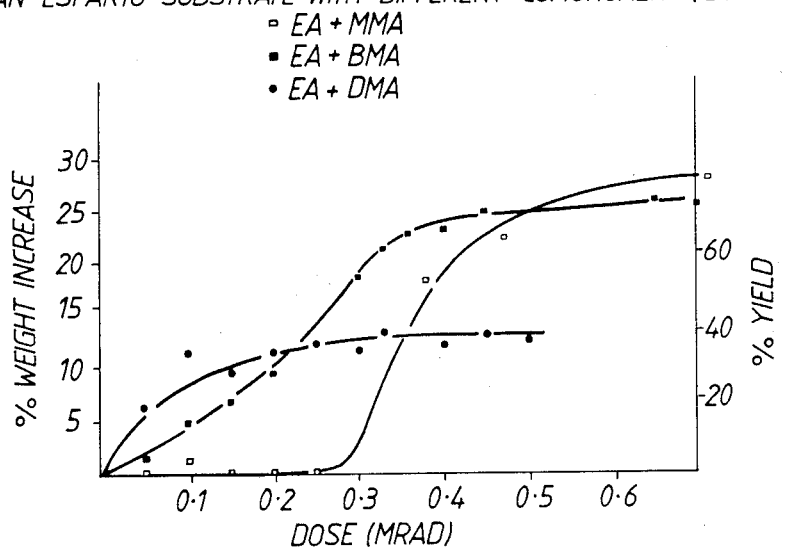
Figure 14:
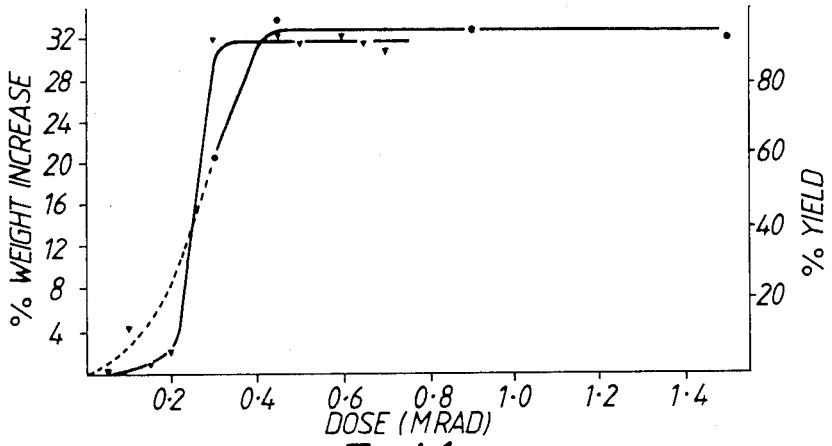
Figure 15:
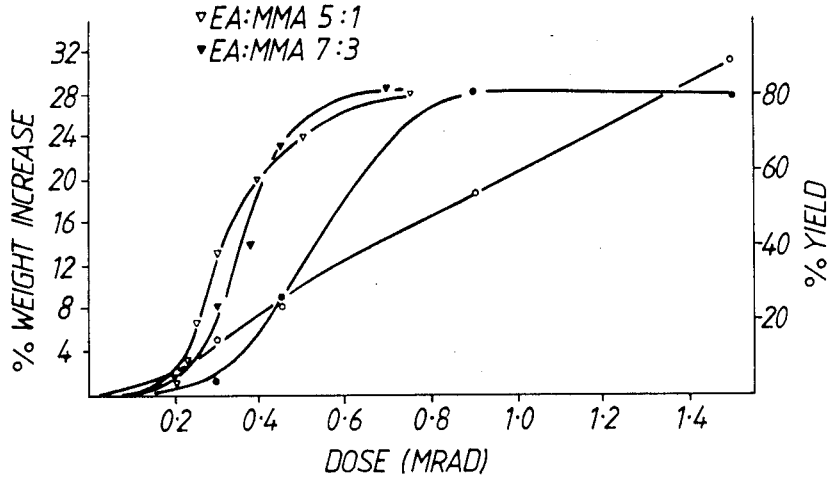
Figure 16:
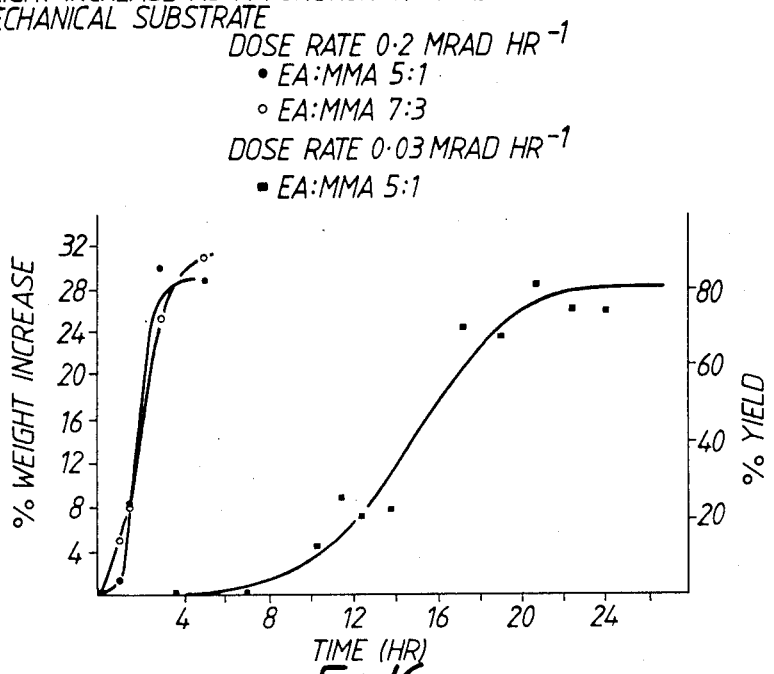
Figure 17:
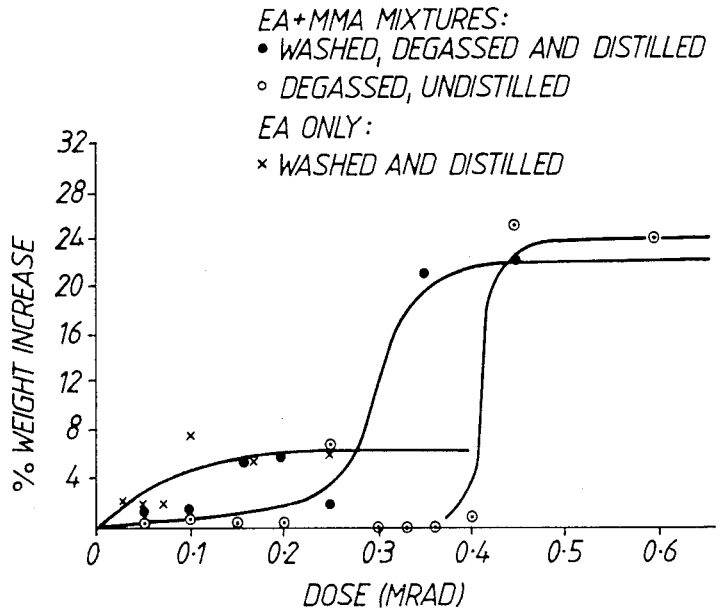
Figure 18:
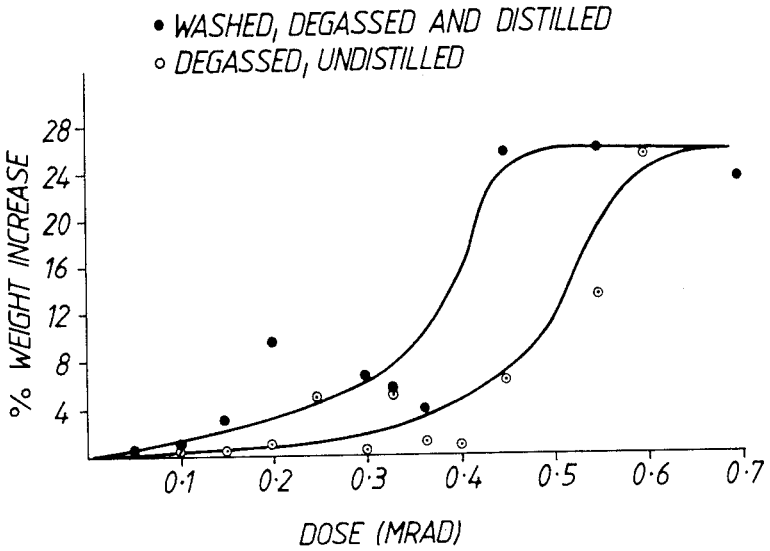

(ii) comparing polymerisation of individual monomers and a mixture thereof (FIG. 10);

(iii) comparing different ratios of monomers and different substrates (FIGS. 11 and 12); and (iv) comparing different comonomers (FIG. 13); FIGS. 14 to 16 illustrate the variation of polymerisation and polymer yield with radiation dose (or time), comparisons being given for substrates reacted under similar conditions, but at two different dose rates, namely 0.03 and 0.3 MRad $hr^{-1}$; and FIGS. 17 and 18 illustrate the variation in weight increase with total radiation dose for two different substrates, comparing the results with distilled and undistilled monomers.

Unless the context indicates otherwise, when used herein, the term "total addition" or "monomer addition" refers to the weight of monomer(s) added compared with the weight of the substrate; the term "weight increase" refers to the increase in weight of the substrate after treatment compared with the weight of the substrate before treatment; and the term "yield" refers to the increase in weight of the substrate compared with the total addition of monomer(s). These terms are expressed as a percentage. "Substrate" denotes the paper or book treated as the case may be.

Figure 5:
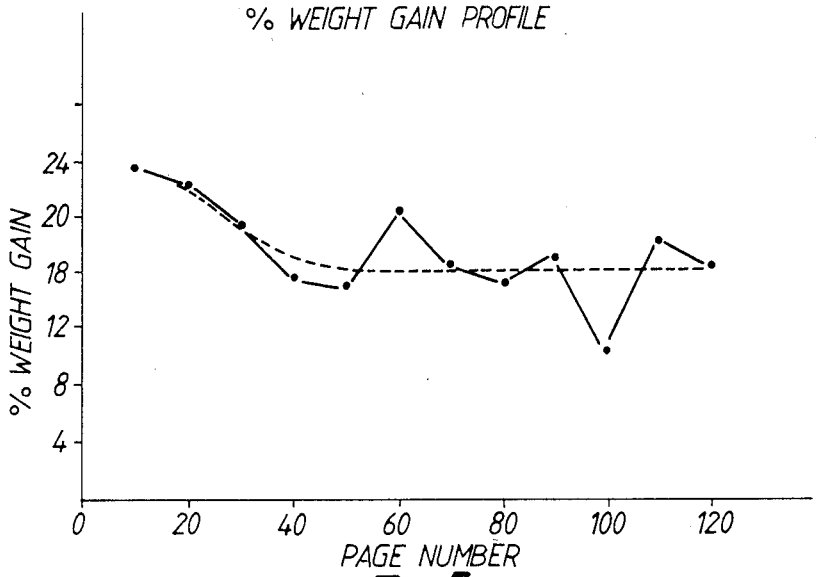
FIG. 5 shows a plot of weight increase of pages of a book treated by a process of the present invention versus book profile.

In the process whose results are shown in FIG. 5, a 5:1 w/w mixture of ethyl acrylate and methyl methacrylate was polymerised at 35 weight % total addition and 0.48 MRad (0.03 MRad/hr for 16 hrs) on various pages of a mechanical paper substrate. Homogeneous distribution of monomer was ensured by mechanical means before the reaction was initiated. The Figure shows that deposition of polymer was reasonably homogeneous. Even if reaction times are long, an even distribution can be maintained by, for example, rotation.

Figure 6:
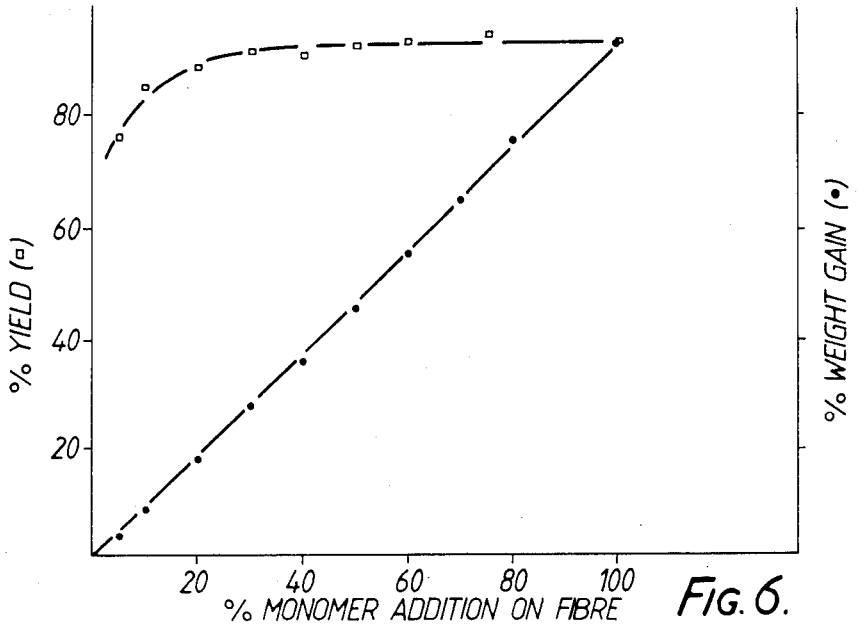
FIG. 6 shows plots of polymer yield and weight increase of a pure cotton paper treated by a process of the present invention versus weight of monomer addition.

In the process of FIG. 6, 5:1 w/w ethyl acrylate/methyl methacrylate mixtures were polymerised at 0.48 MRad on a pure cotton paper using different total monomer additions. Plots were made of % yield (open squares) and % weight increase (closed circles) versus monomer addition. The percentage sheet weight increase is directly proportional to the weight percent monomer addition. Yield is approximately constant over the entire range, except possibly at low levels of monomer addition, where reduced yields are observed.

Figure 7:
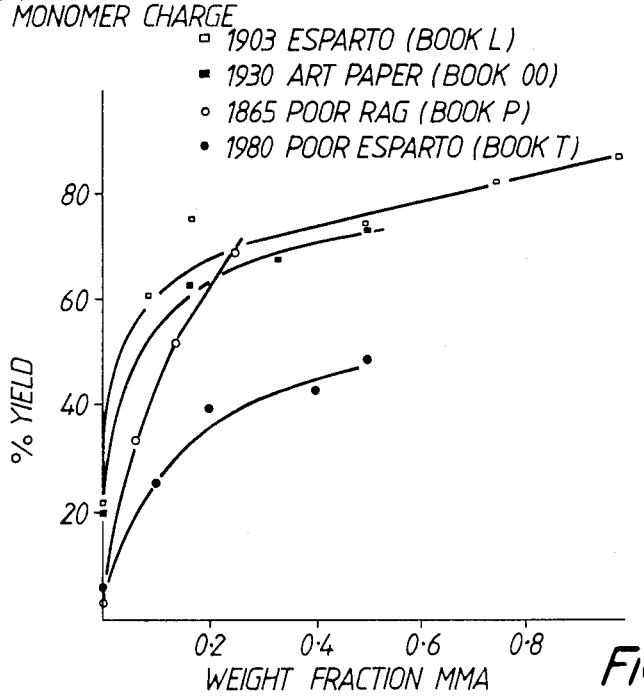
FIG. 7 illustrates the variation of final polymer yield with fraction of methyl methacrylate in a mixture of ethyl acrylate and methyl methacrylate.

In the process of FIG. 7, different substrates were treated at a dose of 0.48 MRad and 35 weight % total addition with mixtures of ethyl acrylate+methyl methacrylate of different proportions. For each substrate the yield was plotted versus fraction of methyl methacrylate in the mixture. The Figure shows a rapid increase in final yield with only a small fraction of added methacrylate monomer. All aged and woody substrates tested exhibited similar increases.

FIGS. 8 to 18 are various plots of reaction rates.

Figure 8:
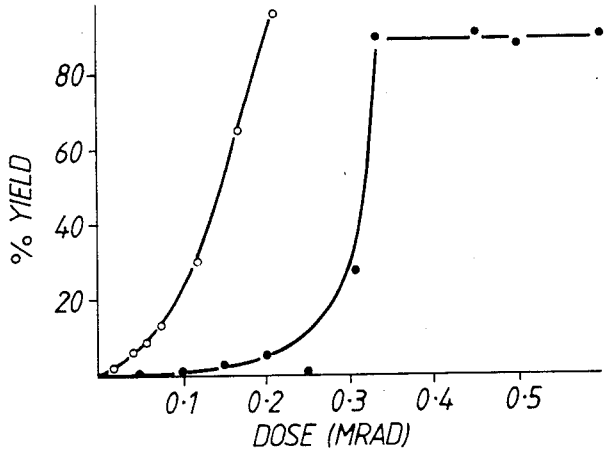
FIG. 8 shows a plot of percentage yield as a function of total dose for polymerisation in a pure cotton paper and in bulk.

In the process of FIG. 8, a 5:1 w/w ethyl acrylate/methyl methacrylate mixture was polymerised at 0.03 MRad $hr^{-1}$ on a pure cotton paper (35 weight % addition) and in bulk. The results show that, excluding initial rates, the rates of polymerisation in pure cotton paper and in bulk are both similar. Thus, with the exception of the first 15-20% (yield) of polymerisation, the rate of polymerisation appears to be largely independent of the substrate, at least with pure cotton paper. This suggests yet again that the reduced rate of polymerisation observed initially in some paper substrates may be due to a factor (possibly oxygen) whose effect is exhausted in the early stages of polymerisation, after which monomer conversion proceeds more-or-less normally.

Figure 9:
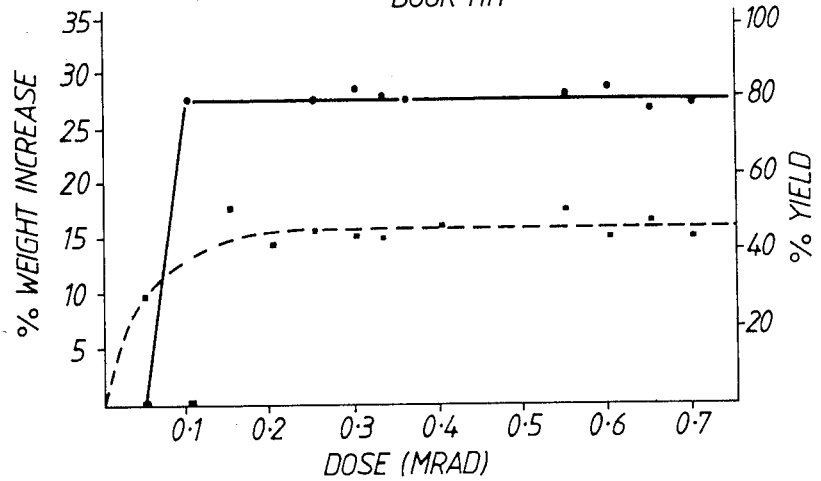
FIGS. 9 to 13 illustrate the variation in weight increase with total radiation dose (i) comparing polymerisation of ethyl acrylate alone on a pure cotton paper and on an aged mechanical paper substrate (FIG. 9).
Figure 11:
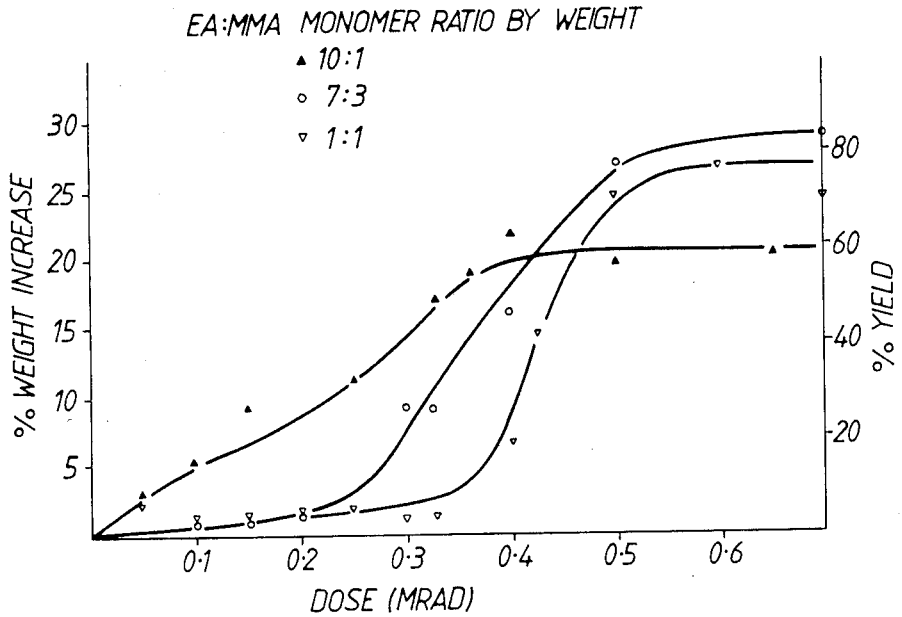

In FIGS. 9 to 13, a dose rate of 0.03 MRad/hr was employed for different periods of time to allow a plot of weight increase (or yield) versus total dose. FIG. 9 shows a greater rate of reaction on a pure cotton paper than on the aged mechanical paper substrate, and a higher final yield on the former. In FIG. 10 on an esparto substrate the results for ethyl acrylate alone, methyl methacrylate alone and a 5:1 w/w ethyl acrylate/methyl methacrylate mixture (with 35 weight % total addition) are compared, and in FIGS. 11 and 12 for the above esparto substrate and for mechanical substrates respectively the results for different monomer ratios (each with 35 weight % addition) are compared. FIG. 10 shows the yield-enhancing effect of addition of methyl methacrylate to ethyl acrylate after an initial induction period corresponding in this case to approximately 0.35 MRad. However, as shown in FIG. 11, there is a distinct trend to reduced initial reaction rate with increasing methyl methacrylate component.

In FIG. 13, 5:1 w/w mixtures of ethyl acrylate and, respectively, methyl methacrylate, butyl methacrylate or dodecyl methacrylate were polymerised on an esparto substrate at 35 weight % total addition. Similar enhanced yields were obtained with ethyl acrylate/methyl methacrylate and ethyl acrylate/butyl methacrylate mixtures, although with the latter the rate profile did not exhibit such a marked induction period, but merely a reduced initial rate with an acceleration after a radiation dose of about 0.2 MRad. Ethyl acrylate/dodecyl methacrylate mixtures, however, appeared to behave in a similar manner to ethyl acrylate only (compare FIG. 10). (Although there was an improvement in final yield with dodecyl methacrylate, this does not appear to represent a synergistic effect, but is attributable to increased monomer boiling point, leading to increased polymerisation in the sheet.)

In FIGS. 14 to 16 results of polymerisation of ethyl acrylate/methyl methacrylate mixtures at a dose rate of 0.3 MRad/hr and of 0.03 MRad/hr are compared by plots of weight increase or yield versus total dose given (FIGS. 14 and 15) and versus period of irradiation (FIG. 16). The effect on yield of different monomer ratios (EA:MMA 5:1 and 7:3 w/w) is also shown (FIGS. 15 and 16). As will be seen, the maximum polymer yield for any given substrate and monomer ratio is substantially independent of dose rate. However, the maximum yield at the higher dose rate is achieved at higher total doses of irradiation than at the lower dose rate. For example, for the esparto-based sample (FIG. 15), for the 5:1 w/w mixture the required dose for maximum yield at a rate of 0.3 MRad $hr^{-1}$ was substantially more than that required at the lower dose rate of 0.03 MRad $hr^{-1}$; nevertheless, the total dose of approximately 0.9 MRad was still below the threshold at which measurable fibre damage occurs.

The Figures suggest that a higher EA:MMA ratio might produce excellent final yields at lower total radiation dose. A slight reduction in sheet strength improvement would also be expected if the ratio was increased from 5:1 w/w EA:MMA to, say, 10:1 w/w EA:MMA.

Although somewhat greater doses of radiation are required at a higher dose rate, as shown in FIGS. 14 and 15, the actual rate of reaction is much increased (FIG. 16). Clearly, the much shorter reaction times required present economic advantages. In addition, control of homogeneity of deposition would be facilitated by faster reaction times as gravity-induced monomer drainage down the book will be greatly reduced.

In FIGS. 17 and 18, 5:1 w/w ethyl acrylate/methyl methacrylate mixtures are polymerised after squirting on to aged esparto and 1960s mechanical paper substrates respectively, the results obtained with undistilled and distilled monomers being compared. As in other experiments (where distilled monomers are used), there was a delay in onset of any significant reaction, but this delay was longer with the undistilled monomer mixture; final yields, however, were substantially the same.

There are several features of these rate curves which shed some light on the mechanism of the process.

(1) There is a marked delay (FIG. 10) in the onset of reaction with methyl methacrylate and ethyl acrylate/-methyl methacrylate. Little or no polymerisation appeared to occur until a dose of about 0.3 MRad was applied. Delay in polymerisation is independent of the substrate and occurs even with the purest substrate, namely, pure cotton paper (FIGS. 8 and 14). This reaction delay would seem to be an induction period.

(2) The rate of polymerisation for a methyl methacrylate-containing system was very rapid after a 0.3 MRad dose.

(3) Whilst there is no real induction period with pure cotton paper for ethyl acrylate-treated samples, there is evidence of retardation of polymerisation with aged samples (FIG. 9). Under these circumstances the competition between reaction within the paper and on the vessel walls becomes important. Indeed, significant quantities of polymer were observed on the walls of the vessel after only 0.05 MRad under these conditions. The rapid rate of polymerisation of ethyl acrylate in pure cotton paper effectively swamps the competing reaction on the vessel walls.

(4) Enhanced yields were also obtained with ethyl acrylate/butyl methacrylate mixtures (FIG. 13) although the rate profile did not exhibit such a marked induction period; the rate curve of ethyl acrylate/dodecyl methacrylate resembled that of ethyl acrylate only.

(5) Little or no polymerisation occurs on the reaction vessel walls when methyl methacrylate is used as monomer or comonomer.

A possible explanation of the induction period observed with methyl methacrylate polymerisation is the presence of an impurity within the monomer itself. While this is undoubtedly true for the undistilled monomer, as shown in FIGS. 17 and 18, (inhibitor is added by the manufacturers), it does not appear to be the case for the monomer(s) generally used in the process of the invention which was always carefully degassed and distilled, and oxygen-free nitrogen blown through the monomer for 5 minutes prior to use. Moreover, no significant variation in polymer yields have been observed between individual monomer batches. In addition, it seems unlikely that methyl methacrylate and butyl methacrylate are both contaminated and that each contaminant contrives to produce a positive effect on yield. If a contaminant were present in the methyl methacrylate it would necessarily be volatile and should have been removed during degassing procedures.

Reactivity ratios for free radical polymerisation for some acrylate/methacrylate mixtures are given in Table 1.

TABLE 1

REACTIVITY RATIOS OF SOME ALKYL ACRYLATE: ALKYL METHACRYLATE MIXTURES*

| | $r_1$ | $r_2$ | Temperature °C. |
|---|---|---|---|
| MA:MMA | 0.34 | 1.69 | 60 |
| | 0.35 | 1.8 | 65 |
| | 0.36 | 2.23 | 50 |
| EA:MMA | 0.24 | 2.03 | 60 |
| | 0.28 | 2.0 | 60 |
| | 0.47 | 1.83 | 50 |
| BA:MMA | 0.20 | 1.74 | 60 |
| | 0.37 | 1.8 | 60 |
| BA:BMA | 0.3 | 2.2 | 50 |

*Polymer Handbook, Eds. Brandrup, J. and Immergut, E. H. 2nd ed. part II - 55, Wiley-Interscience (1975).

Reactivity ratios $r_1$ and $r_2$ for the first and second monomers respectively are given by the equations:

$$r_1 = k_{11}/k_{12}$$

$$r_2 = k_{22}/k_{21}$$

and predict the relative reactivity of each monomer radical species for both comomoners present:

($K_{nm}$ the probability that a radical of the monomer species n will react with a molecule of the monomer species m; e.g.

$k_{11}$ represents the probability that a radical of the 1st monomer species will react with a monomer molecule of the same species $k_{12}$ represents the probability that a radical of the 1st monomer species will react with a molecule of the 2nd monomer species).

The rates of polymerisation (but note that these are not for polymerisation initiated by gamma-radiation) for methyl and ethyl acrylate are approximately an order of magnitude greater than those of methyl and butyl methacrylate. Dodecyl methacrylate, however, has a rate of polymerisation comparable to, or slightly greater than, the alkyl acrylates. The reactivity ratios for alkyl acrylate/alkyl methacrylate free-radical copolymerisation show that with methyl or butyl methacrylate as comonomer both acrylate and methacrylate radicals will react preferentially with methacrylate monomer. However, no reactivity ratios are available for mixtures of acrylate+dodecyl methacrylate. In view of the substantially higher rate of polymerisation of dodecyl methacrylate it is not obvious whether the reactivity ratios for copolymerisation with alkyl acrylates would conform with those of other methacrylates. Nevertheless, the interaction of the rates of polymerisation and the reactivity ratios of the various monomer mixtures will influence the polymer yield and hence the efficiency of the paper treatment.

The observation that dodecyl methacrylate-containing monomer mixtures do not show as great an enhancement in yield as methyl or butyl methacrylate-containing mixtures (in fact: no synergistic effect) is significant. The difference between dodecyl methacrylate and the other methacrylate monomers used is that the rate of polymerisation of dodecyl methacrylate is comparable with that of the alkyl acrylates.

A possible explanation is that reaction is retarded within the aged sheets for radiation-initiated polymerisation of alkyl acrylates alone. This leads to increased polymerisation externally to the sheet and, hence, deposition on the walls of the reaction vessel. The higher yields observed when methyl and butyl methacrylate are polymerised alone may be directly attributable to the lower rate of reaction. As polymerisation is relatively slow both for reaction in the paper and exterior to the paper (mainly on the wall of the reaction vessel), radicals produced during irradiation have a finite probability of interaction with the contaminant within the aged papers; thus the inhibitor is scavenged before there has been too much polymerisation externally to the sheet, so that overall yield is better than in the case of the alkyl acrylates.

In the case of alkyl acrylate/methyl methacrylate mixtures, similar behaviour may be occurring. The reactivity ratios are such that for either monomer radical preferential reaction should occur with methyl methacrylate monomer. Since the rate of polymerisation of methyl methacrylate is an order of magnitude lower than that of ethyl acrylate, an effective reduction in the overall rate should occur, increasing only as methyl methacrylate is consumed. The initial slowing down of the reaction (including that external to the sheet) allows a period for scavenging of inhibitor which was responsible for reduced yield of polymerisation in the paper (allowing the competing external polymerisation to dominate). In a manner analogous to that described for methyl methacrylate alone, the reactivity within the paper should increase with radiation dose and a higher final yield result.

Conversely, no such rate reduction should occur when dodecyl methacrylate is employed as comonomer and yields comparable to those obtained with ethyl acrylate only should result. The observed yields are in broad agreement, particularly if an adjustment is made for the low volatility of dodecyl methacrylate (b.p. >300° C.).

Clearly, however, more research is required to explain fully the mechanism of yield enhancement in the treatment of aged and woody papers.

On the basis of the above tentative explanation, however, we suggest that, in particular where monomers of the general formula I given above are used, overall improvement in yield may be obtained by selecting the components of the polymerisation system such that (i) the free radical of one component reacts rapidly with oxygen and/or other inhibitor in and/or on the paper, i.e. one component should be capable of acting as scavenger of the inhibitor, (ii) there should be, at least initially, a comparatively slow reaction rate.

In particular, (a) there should be an initial reduction in the reaction rate, i.e. the rate of reaction of the yield-enhancing monomer (the minor component) should be significantly lower than that of the main monomer component, for example more than twice as low, more especially a factor of 10 times slower, and (b) the reactivity ratios of the monomers should be such that the free radicals of both types of monomer react preferentially with molecules of the yield-enhancing monomer.

The identity of the main monomer component is determined, inter alia, by the physical characteristics of its polymer; for our purpose a flexible polymer is required.

Using the process of the present invention, high yields of approximately 80% polymer based on added monomer have been achieved with almost all paper types. The importance of high polymer yields is considerable. A high yield process is clearly more economic than a low yield one. More importantly, in a high yield process, the polymer is deposited preferentially, indeed almost exclusively, in the paper, and polymerisation on the reactor vessel walls or in the most reactive substrate is minimised. Deposition between the sheets is likewise eliminated.

By the process of the present invention the effect of acid-catalysed degradation of the cellulose can be substantially reduced and some of the original paper strength can be recovered.

The process also has the advantage that no cosolvents need be added to increase penetration or yield (indeed the amount of such liquid present should be kept to a minimum), and there is in general no need to prepare the substrate before polymerisation can take place.

Furthermore, the present process employs low doses of radiation and large improvements in sheet strengths, as measured by fold endurance tests, are obtained with low addition of polymer.

The onset of translucency on treated sheets appears to be dependent on grammage, bulk and the weight of polymer deposited. In bulky samples, e.g. pure cotton paper, translucency has been observed with weight increases of 50% and above, whilst low grammage, low bulk, samples such as newsprint exhibited the onset of translucency at weight increases of only approximately 30%. However, generally, such large weight increases are substantially greater than those necessary to provide adequate strength improvements and adequate resistance to acid attack.

Microscopic study of cross-sections of treated samples indicates clearly that no significant variation in sheet thickness occurs for a range of different paper samples and fibre types. This is a consequence of the use of a substantially non-aqueous system (generally also substantially solvent-free) and contrasts with processes involving the use of a cosolvent which would also act as swelling agent for the fibre. (Generally, the process of the present invention uses a substantially solvent-free system.) Neither is the mode of polymer deposition akin to lamination or U.V.-initiated surface deposition where measurable changes in sheet thickness might be expected, and do occur: the interaction of polymer and fibre is much more intimate in γ-initiated mutual polymerisation.

The process of the invention provides, for the first time, a practical method of treating lignin-containing fibres under mild conditions.

Thus, for the preservation of archival material, the process of the present invention is especially advantageous: treated papers show considerable resistance to degradation by acid and there is minimum discolouration, no noticeably different surface texture and negligible change in paper thickness.

Development work has shown that the process of the present invention can be applied routinely to cross-sections of books and, indeed, complete books. Polymer yield is comparable with that obtained with loose leaf systems. Polymer is evenly deposited throughout the book section and significant increases in fold endurance of some ten times have been obtained. The book samples do not appear to require "fanning out" during treatment. Indeed, as the liquid monomer is capable of weakening some binding adhesives, notably hot melt adhesives, it may be advantageous to ensure samples are closely packed together. Homogeneity is also more readily maintained in this way. Upon completion of polymerisation, the binding strength appears to be actually enhanced.

The following Examples illustrate the invention. Except where otherwise indicated, all percentages and ratios given in these Examples are by weight.

EXAMPLES

Method

Paper samples—a minimum of 24 sheets held together—were weighed and placed in a reaction vessel and degassed at reduced pressure. A nitrogen atmosphere was then established in the vessel. The monomer or monomers used, degassed, distilled under vacuum and purged with nitrogen prior to use, were squirted onto the samples or condensed within the samples from the vapour; in general those monomers with low volatility, e.g. dodecyl methacrylate, were introduced as a liquid, and monomers with high volatility, e.g. methyl methacrylate, were introduced from the vapour phase. The impregnated samples were then conditioned for 12 hr or more on a rotating drum to ensure homogeneity of monomer(s) within the sheet, and the samples were subsequently irradiated in a cobalt 60 source to effect the polymerisation. Unless otherwise specified, the dose of γ-rays given was approximately 0.45–0.48 MRad at a dose rate of $30\times10^3$ Rad $hr^{-1}$ (0.03 MRad/hr) for about 15 to 16 hours. The pressure in the reaction vessel during irradiation was atmospheric and the temperature 20° C.

Treatment of mixed substrates was carried out with alternating blocks of sheets or, in some cases, alternating individual sheets.

Cross-sections of books, including spine and covers, were treated in the same way.

The treated material was then removed from the reaction vessel and allowed to equilibrate until air dry. For testing, the material was transferred to a constant temperature and constant humidity chamber (23° C.±1° C. at 50%±2% RH).

Measurements and tests were carried out as follows:

1 Percent weight increase and polymer yield

The samples were weighed and the percentage weight increase in the samples calculated. From the weight increase and the known weight of monomer or monomers used, the percentage polymer yield was calculated.

2. Fold Endurance

Fold endurance tests were carried out according to the method of ASTM D 685/73 D 2176 using an MIT tester. The paper samples are folded repeatedly under constant tension (0.5 kg load) and at a constant rate until they break, the number of folds required being taken as a measure of sample strength. An evaluation of this test as a means of measuring strength is given by R. Cardwell, L. Lyon and P. Luner in *Tappi*, 1972, 55 (2), 228.

It is difficult to give exact figures for "satisfactory" or "unsatisfactory" fold endurance values or increases, since these are relative to the initial fold endurance value. For example, if the initial value is 20, an increase to ~100 would be a vast improvement, but if the initial value is ~100, the same absolute increase would represent less of an improvement. The aim of course is to increase fold endurance, so even small increases are beneficial, although a final fold endurance of ≦20 would not be satisfactory. Preferably, the final fold endurance should be ≧40, especially ≧60, and more especially ≧80, and very especially ≧100–150. Preferably the increase should be ≧2 fold, especially ≧3 fold, more especially ≧4 fold.

3. Acid-Ageing

Paper samples were soaked with 10% (by volume) sulphuric acid at 20° C. for varying time intervals, then washed, neutralised and air dried; the strength of the degraded paper samples was then assessed by fold endurance tests after pre-conditioning at 50% RH. Resistance to immersion of treated sheets in 10% sulphuric acid for periods exceeding 200 hours may be regarded as satisfactory.

4. Dimensional Measurements

Microscopy was used to detect any changes in sheet thickness of treated samples. The method of Bridgeford (Bridgeford, D. J., I and EC Product Research and Development 1, 45 (1962)) was used in the preparation of papers for optical microscopy. The samples were soaked in hydrazine hydrate to convert the ester groups of the polymer into hydrazides, which were then developed with Tollen's reagent. Microtome sections were then prepared and thicknesses measured at 400× magnification using a calibrated graticule. Dimensional change of no more than 2 %, more especially 1%, may be regarded as satisfactory.

Examples 1 to 5 show the use of the process of the invention to improve fold endurance, including investigation of various factors affecting this.

Examples 6 to 12 relate to investigations of practical aspects concerned with performing the process of the invention (using the mixed monomer method), including further tests on the treated products.

Examples 13 to 16 relate to the investigation of various factors affecting yield, using the mixed monomer method.

Example 17 relates to the effect of monomer boiling point on yield.

Examples 18 and 19 relate to other methods to improve yield.

Abbreviations used in the Examples and elsewhere in the specification are as follows:

MA—Methyl acrylate
EA—Ethyl acrylate
BA—Butyl acrylate
MMA—Methyl methacrylate
EMA—Ethyl methacrylate
BMA—Butyl methacrylate
DMA—Dodecyl methacrylate
EHA—2-ethylhexyl acrylate
AM—amine-substituted alkyl methacrylate (2-(dimethylamino)ethyl methacrylate)
VC—Vinylidene chloride
I—Isoprene
AN—Acrylonitrile
THPC—Tetrakis(hydroxymethyl)phosphonium chloride
F.E.—fold endurance Books used in the process and referred to in the Examples or Figures were as follows:

| BOOK | PUBLICATION DATE | FURNISH | ORIGINAL FE |
|---|---|---|---|
| C | 1828 | Rag | 46 ± 21 |
| E | 1874 | Esparto | 26 ± 7 |
| I | 1838 | Good machine coated rag | 80 ± 35 |
| K | 1839 | Rag | 13 ± 3 |
| L | 1903 | Esparto/wood free fibre | 9 ± 1 |
| M | 1877 | Wood/esparto | 4 ± 1 |
| P | 1865 | Poor rag/some esparto + starch | 6 ± 2 |
| S | 1910 | Esparto/wood | 8 ± 1 |
| T | 1890 | Poor esparto + starch | 17 ± 8 |
| W | 1799 | Bad rag | 31 ± 10 |
| X | 1913 | Esparto | 15 ± 3 |
| Z | 1969 | British mechanical | 27 ± 15 |
| AA | 1954 | Esparto/wood | 14 ± 2 |
| BB | 1977 | British mechanical | 131 ± 96 |
| CC | 1977 | Finnish mechanical | 335 ± 119 |
| DD | 1965 | Swedish mechanical | 62 ± 48 |
| FF | 1973 | Canadian mechanical | 54 ± 37 |
| HH | 1943 | U.S. mechanical | 4 ± 1 |
| II | 1960 | U.S. mechanical | 12 ± 4 |
| OO | 1930s | Art paper | 20 ± 4 |
| UU | * | Esparto/wood | 38 ± 23 |
| WW | 1930s | Art paper | 8 ± 2 |
| XX | 1920–1930 | Art paper | — |
| 7A | 1966 | Mechanical | — |

*not known

The newsprint used in the Examples was modern newsprint. The pure cotton sample used in the Examples was Whatmans filter paper.

EXAMPLE 1—COMPARISON OF SOLVENT-FREE POLYMERISATION AND SOLUTION POLYMERISATION

Polymerisation of ethyl acrylate was carried out, according to the above-described general method using 0.45 MRad, on a pure cotton paper. In a comparative experiment a mixture of ethyl acrylate and degassed methanol in a ratio of acrylate to methanol of 3:1 was used. The experiment was also repeated with a 4:1 mixture of ethyl acrylate and methyl methacrylate.

The percentage of monomer used, calculated on the weight of the substrate, and the results are shown in Table 2.

TABLE 2

Effect of monomer, solvent and monomer mixture on polymer yield and fold endurance
Monomer addition: 30%.

| SUBSTRATE | REAGENTS | % WEIGHT INCREASE | % YIELD | FOLD ENDURANCE |
|---|---|---|---|---|
| PURE COTTON PAPER | BLANK | 0 | 0 | 44 |
| | EA | 22.4 | 75 | 2522 |
| | EA + METHANOL(3:1) | 26.7 | 89 | 46 |
| | EA + MMA(4:1) | 24.6 | 81 | 6987 |

Good results were obtained with the solvent-free systems.

When solvent was used, we believe that polymerisation of the ethyl acrylate occurred in solution in the methanol (ethyl acrylate is soluble in methanol), not within the paper sheets, so that there was no direct contact of the monomer with inhibitor in the sheets, and good yields were achieved. However, as demonstrated by electron microscopy, the result was a polymer deposited in discrete particles on the surface of the sheets, and with no inter-fibre linking (the polymer is insoluble in methanol), which could account for the poor fold endurance.

EXAMPLE 2—TESTS ON NEW AND OLD PAPERS

Using the same ethyl acrylate+methyl methacrylate mixture (5:1), the same total addition (35%) and the same dose of radiation (0.45 MRad) each time, various different substrates were treated according to the general procedure described above. The substrates consisted of modern and aged paper samples; the fold endurance of the untreated modern samples was noticeably higher than those of the untreated aged samples.

The results are given in Table 3a (for the modern papers) and Table 3b (for the aged papers).

TABLE 3a

Treatment of various modern papers

| Substrate | TREATED % weight increase | TREATED % polymer yield | F.E. |
|---|---|---|---|
| (Chemical) Longbow | 24.6 | 70 | 3158(175) |
| (Chemimechanical) Longbow Wove | 22.9 | 65 | 774(295) |
| (Art) Nimrod Cartridge | 26.6 | 76 | 4489(632) |
| (Art) Buccaneer Matt | 26.5 | 76 | 4323(237) |

( ) Original fold endurance

TABLE 3b

Treatment of various book samples

| Substrate | TREATED % weight increase | TREATED % polymer yield | F.E. |
|---|---|---|---|
| Book K Rag | 24.4 | 70 | 119(13) |
| Book L Esparto/WFF | 23.1 | 66 | 328(9) |
| Book M Wood/esparto | 19.6 | 56 | 17(4) |
| Book HH | 24.5 | 70 | 16(4) |

TABLE 3b-continued

| Treatment of various book samples | | | |
|---|---|---|---|
| | TREATED | | |
| Substrate | % weight increase | % polymer yield | F.E. |
| Mechanical | | | |
| Book I | 19.4 | 55 | 1631(80) |
| Rag | | | |

( ) Original fold endurance

Consistently good results were obtained with the modern papers. With the aged papers, substantial improvement in fold endurance resulted for the non-wood-derived fibres, but for the I877 wood/esparto sample (M) and the 1943 mechanical paper sample (HH) the fold endurance was porr. We believe that when the untreated substrate has a fold endurance below about 15 or 20, satisfactory improvement in fold endurance cannot be guaranteed, even with good polymer yields. It seems likely that below a threshold fibre length, the fibre network is sufficiently impaired that addition of polymer has little effect.

EXAMPLE 3—TESTS USING DIFFERENT MONOMERS AND MONOMER COMBINATIONS

Polymerisation was carried out with a number of different monomers and monomer combinations.

The substrate, monomer(s) used and other details of the tests, as well as their results, are given in Table 4.

As can be seen from the Table, good results were obtained when alkyl acrylates were mixed with methyl, ethyl or butyl methacrylate. Terpolymers of ethyl acrylate: methyl methacrylate: vinylidene chloride also exhibited good strength characteristics; sheet opacity was improved compared to sheets treated with the acrylate/methacrylate mixture only. However, when vinylidene chloride was used on its own or when isoprene or isoprene+acrylonitrile were used, the final fold endurance was less than the initial fold endurance.

EXAMPLE 4—TESTS USING DIFFERENT TOTAL ADDITION

Tests on modern mechanical and aged paper samples were carried out using a 5:1 ethyl acrylate+methyl methacrylate mixture wiht 35 % and 45 % total monomer additions and 0.45 MRad in each case.

The results are given in Table 5.

TABLE 5

| Effect of percentage addition on polymer yield | | | | |
|---|---|---|---|---|
| | | TREATED | | |
| Substrate | % Total monomer addition | % weight increase | % polymer yield | F.E. |
| Book DD | 35 | 26.4 | 75 | 159(62) |
| | 45 | 35.1 | 78 | 467(62) |
| Book I | 35 | 20.4 | 58 | 668(80) |
| | 45 | 27.8 | 62 | 2098(80) |

( ) Original fold endurance

The yield and fold endurance increased as the ethyl acrylate and methyl methacrylate additions increased.

A more detailed investigation of the effect of different monomer additions on yield and fold endurance was then carried out using a pure cotton paper, 0.48 MRad and a 5:1 ethyl acrylate/methyl methacrylate mixture. The results are shown in Table 6 below.

TABLE 6

| Dependence of Fold Endurance on % Weight Increase with different total additions | | | |
|---|---|---|---|
| % monomer addition | % weight increase | % yield | Fold Endurance (Original F.E.: 44) |
| 5 | 3.8 | 76 | 103 ± 35 |
| 10 | 8.5 | 85 | 634 ± 291 |
| 20 | 17.8 | 89 | 3154 ± 1610 |
| 30 | 27.3 | 91 | 5720 ± 2086 |
| 40 | 36.3 | 90 | 9632 ± 1686 |
| 50 | 46.0 | 92 | 12,347 ± 3544 |
| 60 | 55.9 | 93 | 12,689 ± 1128 |
| 70 | 65.0 | 93 | 15,386 ± 4311 |
| 80 | 75.2 | 94 | 19,021 ± 2939 |

The yield and fold endurance of the treated samples increased with the percentage weight increase.

TABLE 4

Different monomer combinations Total addition 35%.

| Substrate | Pure cotton paper | Pure cotton paper | Pure cotton paper | Newsprint | Newsprint | Pure cotton paper | Pure cotton paper |
|---|---|---|---|---|---|---|---|
| Monomer | EA + BMA | BA + MMA | EHA + MMA | BA + MMA | EHA + MMA | EA + MMA + VC | EA + MMA + VC |
| Monomer ratio | 3:2 | 3:2 | 1:1 | 1:1 | 3:2 | 7:1:2 | 8:1:1 |
| Monomer:Solvent ratio | — | — | — | — | — | — | — |
| Cosolvent | None | None | None | None | None | None | None |
| Radiation dose | 0.4 MRad | 0.4 MRad | 0.4 MRad | 0.4 MRad | 0.4 MRad | 0.4 MRad | 0.4 MRad |
| % Weight increase | 31 | 30 | 32 | 23 | 27 | 30 | 29 |
| % Yield | 87 | 95 | 92 | 77 | 78 | 85 | 84 |
| Initial fold | 44 ± 12 | 44 ± 12 | 44 ± 12 | 72 ± 42 | 72 ± 42 | 44 ± 12 | 44 ± 12 |
| Final fold | 6648 ± 2086 | 4514 ± 1497 | 2955 ± 1616 | 395 ± 203 | 270 ± 77 | 3776 ± 1016 | 1230 ± 527 |

| | Comparative Tests | | | |
|---|---|---|---|---|
| Substrate | Pure cotton paper | Pure cotton paper | Pure cotton paper | Pure cotton paper |
| Monomer | I* | I + AN* | VC* | VC* |
| Monomer ratio | 1 | 5:1 | 1 | 1 |
| Monomer:Solvent ratio | 7:4 | 3:2 | 1 | 7:4 |
| Cosolvent | Methanol | Methanol | None | Methanol |
| Radiation dose | 1.0 MRad | 1.8 MRad | 0.7 MRad | 0.7 MRad |
| % Weight increase | 11 | 14.2 | 16 | 30 |
| % Yield | 20 | 40.6 | 46 | 83 |
| Initial fold | 44 ± 12 | 44 ± 12 | 44 ± 12 | 44 ± 12 |
| Final fold | 9 ± 1 | 15.5 ± 5 | 4 ± 1 | 22 ± 4 |

*Comparative example

EXAMPLE 5—TESTS USING DIFFERENT MONOMER RATIOS

At constant total monomer addition (30 %) and constant radiation dose (0.45 MRad), pure cotton paper, newsprint and an aged book sample were treated with ethyl acrylate and with ethyl acrylate+methyl methacrylate mixtures containing different proportions of the two components.

Figure 19:
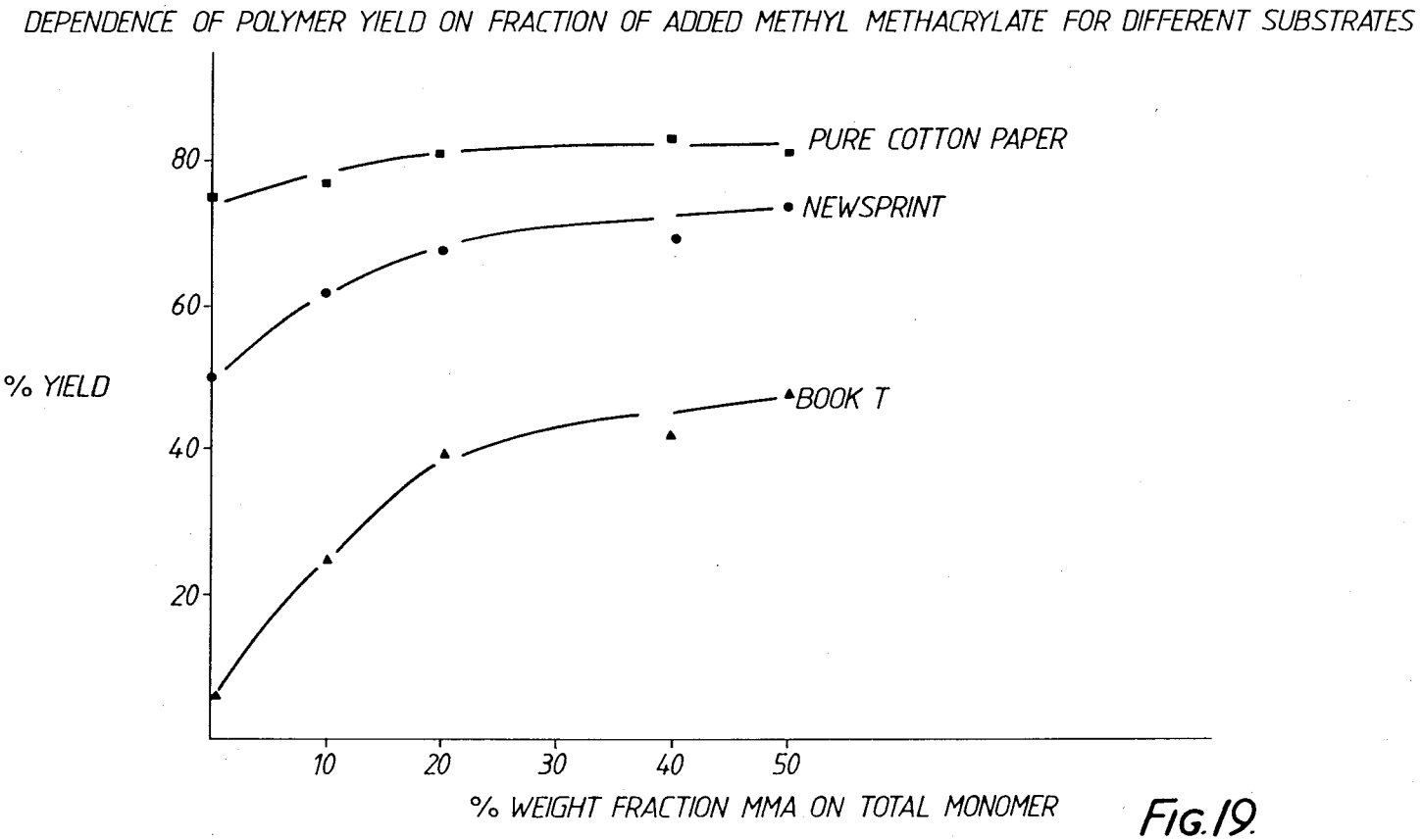

The results are shown in Table 7 and graphically in FIG. 19.

With the aged sample, although (we believe) the monomer mixture was suppressing the effect of inhibitor, as evidenced by increasing yield, little improvement in fold endurance was obtained since the original fold endurance was too poor—the book had degraded too far for the treatment to be of value.

Satisfactory results were obtained, however, in all the tests on pure cotton paper; the weights of polymer deposited on the substrate and the yields were very little changed by the addition of methyl methacrylate to the ethyl acrylate, and at higher proportions of methyl methacrylate more-or-less constant yields were obtained, which confirms our belief that with this substrate—pure cotton—there is only a limited inhibition.

TABLE 7

Dependence of polymer yield on ethyl acrylate/methyl methacrylate ratio

| Substrate | % EA | % MMA | Treated % weight increase | % polymer yield | F.E. |
|---|---|---|---|---|---|
| Pure cotton | 30 | 0 | 22.4 | 75 | 2522 ± 1114(44) |
| | 27 | 3 | 23.0 | 77 | 3338 ± 1154(44) |
| | 24 | 6 | 24.6 | 81 | 6987 ± 2205(44) |
| | 18 | 12 | 24.8 | 83 | 3982 ± 1662(44) |
| | 15 | 15 | 24.3 | 81 | 2507 ± 1160(44) |
| News | 30 | 0 | 14.9 | 50 | 665(72) |
| | 27 | 3 | 18.7 | 62 | 366(72) |
| | 24 | 6 | 20.3 | 68 | 397(72) |
| | 18 | 12 | 20.9 | 69 | 164(72) |
| | 15 | 15 | 22.2 | 74 | 133(72) |
| Book T | 30 | 0 | 1.7 | 6 | 9(17) |
| | 27 | 3 | 7.4 | 25 | 23(17) |
| | 24 | 6 | 11.8 | 39 | 11(17) |
| | 18 | 12 | 12.6 | 42 | 7(17) |
| | 15 | 15 | 14.5 | 48 | 5(17) |

( ) Original fold endurance

With newsprint, the yield was poor, with ethyl acrylate alone, but improved yields were produced with all methyl methacrylate additions, but again there was a levelling off effect at higher methyl methacrylate additions. We postulate that this substrate, being modern, would probably have very little oxygen content, but it contains phenolic material so (if oxygen is involved in inhibition) even trace amounts of oxygen would, we believe, have an inhibiting effect; trace amounts, however, would be exhausted with relatively low additions of methyl methacrylate.

The fold endurance values of the treated pure cotton paper and the newsprint were all good, but the improvements with the newsprint were not as dramatic as with the pure cotton paper. We believe the initial fold endurance of pure cotton paper was low because of limited inter-fibre bonding, and not because of low fibre length or poor flexibility of the fibres themselves. However, the polymerisation process of the present invention increases this inter-fibre bonding-by means of polymer. The newsprint substrate has, however, much shorter fibre length and, therefore, the potential for strength improvement is more limited than in the case of pure cotton paper.

Variation in the fold endurance values of the three substrates as more methyl methacrylate was added is, we believe, partly a function of amount of polymer deposited and partly of the Tg values (methyl methacrylate tends to give brittle polymers - the polymer has a high $T_g$).

EXAMPLE 6—DIMENSIONAL STABILITY

Polymerisation was carried out on various substrates using a mixture of ethyl acrylate and methyl methacrylate and a radiation dose of 0.48 MRad. Weight increase and average thickness before and after treatment were measured. The results and ratio of monomers used are given in Table 8.

No significant variation in sheet thickness occurred. Indeed, there was some suggestion that if anything the in situ polymerisation resulted in a slight contraction in thickness. The variation in sheet thickness were, however, within experimental error.

TABLE 8

Sheet Thickness of treated samples

| SUBSTRATE | EA:MMA RATIO | % WEIGHT INCREASE | AVERAGE THICKNESS (μm) |
|---|---|---|---|
| Pure Cotton Paper | Untreated | 0 | 225 ± 12 |
| | 4:1 | 23.6 | 200 ± 25 |
| Newsprint | Untreated | 0 | 125 ± 20 |
| | 4:1 | 24.1 | 125 ± 20 |
| Pure Cotton Paper | Untreated | 0 | 165 ± 10 |
| | 5:1 | 23.7 | 175 ± 10 |
| | | 24.6 | 160 ± 10 |
| Newsprint | Untreated | 0 | 100 ± 10 |
| | 5:1 | 23.7 | 92 ± 8 |
| Book I | Untreated | 0 | 100 ± 10 |
| | 5:1 | 29.7 | 90 ± 10 |
| Book DD | Untreated | 0 | 90 ± 10 |
| | 5:1 | 19.0 | 80 ± 5 |
| Book HH | Untreated | 0 | 95 ± 10 |
| | 5:1 | 26.0 | 92 ± 8 |

EXAMPLE 7—ACID AGEING TESTS

Ethyl acrylate was polymerised on pure cotton paper using 0.7 MRad and 35 % monomer addition. The results, including those obtained in acid ageing tests, were as follows:

TABLE 9

| | | | | | |
|---|---|---|---|---|---|
| % WEIGHT INCR. | | 22.3 | | | |
| % YIELD | | 64 | | | |
| INITIAL FOLD | | 44 ± 12 | | | |
| TREATED SHEET FOLD | | 1594 | | | |
| ACID AGEING | | (10% $H_2SO_4$ at 20° C.) | | | |
| TIME (HRS) | 0 | 24 | 48 | 120 | 168 |
| BLANK | 44 | 40 | 37 | 32 | 26 |
| TREATED | 1594 | 1698 | 1301 | 1270 | 1079 |
| SHEET DIMENSIONS THICKNESS % CHANGE | | | | | 0 |
| COLOUR | NO VISIBLE CHANGE | | | | |

EXAMPLE 8—USE OF BASIC MONOMER IN MONOMER MIXTURE TO IMPROVE ACID RESISTANCE

Paper samples impregnated wiht acid to a pH of 4.0 were treated at 5% monomer addition and 0.48 MRad with a monomer mixture of ethyl acrylate, methyl methacrylate and amino-alkyl methacrylate, and, for comparison, a mixture of ethyl acrylate and methyl methacrylate.

The results are shown in Table 10.

TABLE 10

EFFECT OF ADDED AMINO-ALKYL METHACRYLATE ON FOLD ENDURANCE

| SUB-STRATE | % WEIGHT IN-CREASE | INI-TIAL pH | FINAL pH | F.E. | MONOMER RATIO EA: MMA:AM |
|---|---|---|---|---|---|
| pure cotton blank | 0 | 4 | 4 | 55 | — |
| pure cotton treated (1) | 13.2 | 4 | 4 | 1850 | 5:1:0 |
| pure cotton treated (2) | 13.1 | 4 | 7.6 | 1805 | 5:1:0.1 |

Alkaline pHs of treated samples were detected by pre-addition of bromo cresol purple indicator which turns blue at pH 8.

The final pH was substantially higher with the co-use of amino-alkyl methacrylate and strength improvements were not impaired at this level of amine addition.

EXAMPLE 9—IMPROVEMENT OF HOMOGENEITY OF POLYMER DEPOSITION

Tests were made on ways of maintaining homogeneity during the polymerisation period (approximately 15 hours).

Preconditioning on a roller after impregnation with the monomer mixtures was routinely carried out prior to irradiation as usual. Samples were loaded into a metal drum which was driven by a battery-powered electric motor, placed in the source and irradiated. The drum was rotated at two speeds: approximately 200 rpm and 60 rpm. In a control experiment there was no rotation during irradiation. The results for individual sheets of pure cotton paper and newsprint are given in Table 11.

TABLE 11

EFFECT OF CONDITIONING ON HOMOGENEITY OF POLYMER DEPOSITION ON INDIVIDUAL SHEETS
35% addition, 0.48 MRad, EA:MMA = 5:1

| SUBSTRATE | % WEIGHT INCREASE | STANDARD DEV. % ( ) | % YIELD | FOLD ENDURANCE | CONDITIONS |
|---|---|---|---|---|---|
| PURE COTTON PAPER | 31.6 | 5.9(19) | 90 | | Preconditioned |
| " | 31.0 | 5.4(17) | 87 | | " |
| " | 31.7 | 7.2(23) | 91 | | " |
| " | 31.4 | 10.9(35) | 91 | 5800 | " |
| " | 30.6 | 4.8(16) | 90 | | " |
| " | 31.7 | 5.8(18) | 87 | | " |
| " | 24.1 | 2.4(10) | 69 | | Mutual Conditioning 200 rpm |
| " | 28.2 | 12.1(43) | 81 | | " |
| " | 27.3 | 12.4(45) | 78 | | " |
| " | 25.2 | 10.3(41) | 72 | | " |
| " | 32.0 | 2.0(6) | 91 | 5132 | Mutual Conditioning 60 rpm |
| " | 26.3 | 1.3(5) | 95 | 3445 | " |
| " | 32.7 | 1.5(5) | 93 | 4102 | " |
| NEWS (4:1) | 21.8 | 3.0(14) | 62 | | Preconditioned |
| NEWS (3:2) | 20.8 | 5.2(25) | 59 | 380 | " |
| " | 18.6 | 2.6(14) | 53 | | Mutual Conditioning 200 rpm |
| " | 28.6 | 2.4(9) | 81 | 334 | Mutual Conditioning |
| " | 27.7 | 1.4(5) | 79 | | " |

In both cases the standard deviation in weight increase for samples rotated prior to irradiation only was on average about 20%. The standard deviation was dramatically reduced to between 5 to 7 % when samples were rotated at 60 rpm during the course of reaction. At the higher speed (200 rpm) higher standard deviations (43%) were generally observed. These results have important ramifications both for overall strength improvements and also in reducing the incidence of localised polymer deposition and hence the formation of translucent spots.

EXAMPLE 10—EFFECT OF DELAYS BETWEEN IMPREGNATION AND INITIATION OF POLYMERISATION

The effect of delay between monomer impregnation and initiation within the γ-source was tested and results are given in Table 12.

Only a slight reduction in yield was observed for samples stored for up to 10 days. Some reduction in yield (30% and 53%) was observed for the two week interval, but in practice it seems unlikely that samples will require storage for more than a few days at most.

TABLE 12

EFFECT OF TIME DELAY ON POLYMER YIELD

| Substrate | | Time delay | % weight increase | % yield |
|---|---|---|---|---|
| Book K | | 24 hours | 24.9 | 71 |
| | | 6 days | 25.1 | 72 |
| | | 9 days | 20.9 | 60 |
| | | 14 days | 14.3 | 41 |
| Book BB | e | 24 hours | 29.1 | 83 |
| | f | 6 days | 27.4 | 78 |
| | g | 9 days | 24.0 | 69 |
| | h | 14 days | 10.4 | 30 |

(EA:MMA = 5:1; 35% addition; 0.48 MRad).

EXAMPLE 11—TREATMENT OF DIFFERENT (MIXED) SUBSTRATES

Mixtures of substrates of varying reactivity were treated by a mixture of ethyl acrylate and methyl methacrylate (5:1 ) at 35 % monomer addition and 0.48 MRad. The total weight of paper treated in each experiment was limited, by the size of reaction vessel, to a total of 24 sheets. The results are shown in Table 13.

TABLE 13

THE EFFECT OF MIXTURES OF PAPERS ON YIELD

| Substrate | % Weight Increase (yield) | % Yield |
|---|---|---|
| Pure cotton/News | Overall 19.8<br>W = 27.0(77)<br>N = 32.6(93) | 85 |
| Pure cotton/ Esparto (Book X) | Overall 26.9<br>W = 34.3(98)<br>E = 19.6(56) | 77 |

TABLE 13-continued

THE EFFECT OF MIXTURES OF PAPERS ON YIELD

| Substrate | % Weight Increase (yield) | % Yield |
|---|---|---|
| News/Esparto (Book X) | Overall 27.7<br>N = 31.7(91)<br>E = 23.6(67) | 79 |
| Pure cotton/News/ Esparto (Book X) | Overall 30.0<br>W = 35.9(102)<br>N = 30.2(86)<br>E = 17.9(51) | 86 |
| Book K/Book II Rag Mech. | Overall 27.4<br>K = 20.3(58)<br>II = 34.5(99) | 78 |
| Book C/Book HH Rag Mech. | Overall 26.5<br>C = 23.5(67)<br>HH = 24.5(70) | 76 |
| Book BB/Book AA Mech. Esparto | Overall 21.3<br>BB = 29.5(84)<br>AA = 13.1(50) | 61 |
| Pure cotton/News* | Overall 28.9<br>W = 25.1(72)<br>N = 32.7(93) | 83 |
| Pure cotton/ Esparto* | Overall 27.3<br>W = 27.2(78)<br>E = 27.3(78) | 78 |
| Pure cotton/News* Esparto | Overall 29.6<br>W = 32.8(94)<br>N = 35.9(103)<br>E = 16.9(48) | 85 |

TABLE 13b

Average Yields for Individual Substrate Treatment

| | % Yield |
|---|---|
| Pure cotton | 88 |
| News | 79 |
| Book X | 74 |
| Book K | 60 |
| Book Y | 20 |
| Book II | 74 |
| Book HH | 83 |
| Book AA | 50 |
| Book BB | 73 |

Notes
Blocks of 6 sheets alternating
*Alternating individual sheets

The results show clearly that polymer is not preferentially deposited in the most reactive substrates at the expense of the other papers present. Indeed, there was some suggestion that the yield of polymer in papers of lower reactivity was frequently enhanced. It is also evident that a moderate increase in the total polymer yield also occured. The reasons for such an increase are not altogether clear. In general, the average total yield of the sample mixtures tested was satisfactory, being in excess of 75%.

EXAMPLE 12—TREATMENT OF BOOK BINDINGS

Preliminary work on scaling-up of the process focussed on the treatment of cross-sections of books. Paperback books containing mechanical paper, bound with hot melt adhesives e.g. polyvinyl acetate and ethylenevinyl acetate copolymer, were selected for treatment. Mechanical fibre-based paperback books represent a particularly important category of readily degradable material.

Some difficulties were encountered with equipment design, in particular small leaks in the system which effectively inhibited polymerisation. In the absence of leaks no obvious or insurmountable problems were apparent. Results are given below.

TABLE 14

| | | | |
|---|---|---|---|
| (a) | SUBSTRATE | PAPER-BACK BOOK CROSS-SECTION - MECHANICAL PAPER (PUB. 1980) | |
| | MONOMER | ETHYL ACRYLATE METHYL METHACRYLATE (5:1) | |
| | MONOMER RATIO | 5:1 | |
| | MONOMER ADDITION | 35% | |
| | RADIATION DOSE | 1.9 MRad* | |
| | % WEIGHT GAIN | 25.6 | |
| | % YIELD | 73 | |
| | INITIAL FOLD | 58 ± 30 | |
| | TREATED SHEET FOLD | 501 ± 30 | |
| | SHEET DIMENSIONS | NO CHANGE | |
| | THICKNESS % CHANGE | | |
| | COLOUR | SLIGHT YELLOWING | |
| | INK FASTNESS | NO CHANGE | |
| | BINDING | APPEARS STRONGER | |
| (b) | SUBSTRATE | BOOK CROSS-SECTION - MECHANICAL | |
| | MONOMER | EA:MMA (5:1) | |
| | RADIATION DOSE | 0.48 MRad | |
| | % WEIGHT GAIN | 12.8 | |
| | % YIELD | 51 | |
| | SHEET DIMENSIONS | No change | |
| | COLOUR | No change | |
| | INK FASTNESS | No change | |
| | BINDING | No change | |
| (c) | SUBSTRATE: | MODERN LEATHER | |
| | MONOMER | (i) ETHYL ACRYLATE | (ii) EA/MMA (5:1) |
| | MONOMER ADDITION | (i) 50% | (ii) 50% |
| | % WEIGHT GAIN | (i) 28% | (ii) 40% |
| | % YIELD | (i) 56% | (ii) 80% |

*polymerisation essentially complete after 0.5 MRad.
Note Overall % yield is the same as for a block of 24 sheets.

Polymer yield was comparable with that obtained with loose leaf systems. Polymer appeared to be evenly deposited throughout the book section and significant increases in fold endurance of some ten fold were obtained. The book samples did not require "fanning out" during treatment.

EXAMPLE 13—EFFECT OF DIFFERENT MONOMERS AND MONOMER MIXTURES ON YIELD

Polymerisation was carried out on a number of substrates using different monomers and monomer combinations. The results are given in Table 15.

Table 15 shows enhanced polymer yield with various monomer combinations but, significantly, no enhancement in polymer yield was observed with the application of mixtures of alkyl acrylates, e.g. methyl acrylate and ethyl acrylate, and poor yields were obtained with the ethyl acrylate and dodecyl methacrylate mixture. One possible explanation for this has been given earlier. The Table also shows, for comparison, results with the individual monomers used alone, and a comparison of some measured yields and yields calculated on the basis that the total yield is the sum of each monomer component (assumed to have reacted quite independently) is given in Table 16. Whilst this assumption is incorrect it highlights the yield-enhancing effect of methacrylate addition (excepting the dodecyl methacrylate). The measured yields were commonly double the calculated yields and in some instances even greater.

TABLE 15

WEIGHT INCREASE AND POLYMER YIELD FOR TREATMENT OF AGED SUBSTRATES WITH A RANGE OF MONOMERS AND THEIR MIXTURES
(35% monomer addition)

| | BOOK L | | BOOK CC | |
|---|---|---|---|---|
| | % wt inc | % yield | % wt inc | % yield |
| MA:MMA* | 24.3 | 69 | 13.3 | 38 |
| EA:MMA* | 23.1 | 66 | 25.5 | 73 |
| BA:MMA* | 23.7 | 68 | 30.1 | 86 |
| EHA:MMA* | 31.5 | 90 | 28.8 | 82 |
| EA:EMA* | 6.2 | 18 | 25.9 | 74 |
| MA:BMA* | 23.5 | 67 | 16.5 | 47 |
| EA:BMA* | 20.1 | 57 | 21.2 | 60 |
| MA:EA 5:1 | 5.2 | 15 | 7.5 | 21 |
| MA:EA 1:5 | 4.5 | 13 | 11.2 | 32 |
| EA:DMA* | 13.5 | 39 | 9.5 | 27 |
| MA | 6.8 | 19 | 5.9 | 17 |
| EA | 9.3 | 26 | 11.9 | 34 |
| BA | 21.9 | 63 | 21.7 | 62 |
| EHA | 35.2 | 100 | 28.0 | 80 |
| MMA | 28.8 | 82 | 24.3 | 69 |
| EMA | — | — | 17.3 | 50 |
| BMA | 31.9 | 91 | 31.4 | 90 |
| DMA | 31.8 | 91 | 32.6 | 93 |

*(5:1 w/w)

TABLE 16

COMPARISON OF MEASURED AND CALCULATED POLYMER YIELDS FOR SEVERAL SUBSTRATES

| | BOOK L | | BOOK CC | |
|---|---|---|---|---|
| | meas. | calc. | meas. | calc. |
| MA:MMA | 69 | 30 | 38 | 26 |
| EA:MMA | 66 | 35 | 73 | 39 |
| BA:MMA | — | — | 86 | 62 |
| MA:BMA | 67 | 31 | 47 | 29 |
| EA:BMA | 57 | 36 | 60 | 42 |
| EA:DMA | 39 | 37 | 27 | 30 |

Ratios of acrylate:methacrylate 5:1 (w/w)

EXAMPLE 14—TEST USING DIFFERENT RATIOS OF MONOMERS

At constant total monomer addition (35%) and constant radiation dose (0.48 MRad), various substrates were treated with different monomers and monomer combinations containing different proportions of the components. The results are shown in Tables 17 to 21.

In general, for pure cotton paper and newsprint, as the percentage of second (yield-enhancing) component increased, the weight increased and yield increased to a maximum.

TABLE 17

DEPENDENCE OF YIELD ON ETHYL ACRYLATE/BUTYL METHACRYLATE RATIO
(0.48 MRad dose, and 35% monomer addition)

| Substrate | Monomer(s) | % Weight Increase | % Yield |
|---|---|---|---|
| Pure cotton paper | BMA only | 29.7 | 85 |
| | EA:BMA 4:1 | 30.2 | 86 |
| | EA:BMA 3:2 | 30.6 | 87 |
| | EA:BMA 1:1 | 30.4 | 87 |
| | EA:BMA 2:3 | 28.8 | 82 |
| News | BMA only | 24.0 | 69 |
| | EA:BMA 4:1 | 21.2 | 61 |
| | EA:BMA 3:2 | 23.5 | 67 |
| | EA:BMA 1:1 | 24.6 | 70 |
| | EA:BMA 2:3 | 24.1 | 69 |

TABLE 18

DEPENDENCE OF YIELD ON METHYL ACRYLATE/METHYL METHACRYLATE RATIO
(0.48 Mrad dose, and 35% monomer addition)

| Substrate | Monomer(s) | % Weight increase | % Yield |
|---|---|---|---|
| Pure cotton paper | MA only | 27.8 | 79 |
| | MA:MMA 4:1 | 30.1 | 86 |
| | MA:MMA 3:2 | 29.1 | 83 |
| | MA:MMA 1:1 | 32.5 | 93 |
| | MA:MMA 2:3 | 32.5 | 93 |
| | MA:MMA 4:1 | 27.2 | 78 |

TABLE 19

DEPENDENCE OF YIELD ON BUTYL ACRYLATE/METHYL METHACRYLATE RATIO
(0.48 MRad dose, and 35% monomer addition)

| Substrate | Monomer(s) | % Weight Increase | % Yield |
|---|---|---|---|
| Pure cotton paper | BA only | 28.0 | 93 |
| | BA:MMA 4:1 | 29.6 | 99 |
| | BA:MMA 3:2 | 29.6 | 95 |
| | BA:MMA 1:1 | 16.9 | 56 |
| News | BA only | 25.9 | 86 |
| | BA:MMA 4:1 | 25.3 | 84 |
| | BA:MMA 3:2 | 17.5 | 58 |
| | BA:MMA 1:1 | 23.0 | 77 |
| Book K | BA:MMA 5:1 | 29.9 | 85 |
| Book S | BA:MMA 5:1 | 21.6 | 62 |

TABLE 20

DEPENDENCE OF YIELD ON ETHYLHEXYL ACRYLATE/METHYL METHACRYLATE RATIO
(0.48 MRad dose, and 35% monomer addition)

| Substrate | Monomer(s) | % Weight Increase | % Yield |
|---|---|---|---|
| Pure cotton paper | EHA only | 31.6 | 90 |
| | EHA:MMA 4:1 | 31.0 | 89 |
| | EHA:MMA 3:2 | 29.8 | 85 |
| | EHA:MMA 1:1 | 32.3 | 92 |
| | EHA:MMA 2:3 | 30.3 | 88 |
| News | EHA only | 26.7 | 76 |
| | EHA:MMA 4:1 | 26.6 | 76 |
| | EHA:MMA 3:2 | 27.2 | 78 |
| | EHA:MMA 1:1 | 24.6 | 70 |

TABLE 21

THE DEPENDENCE OF YIELD ON ETHYL ACRYLATE/VINYLIDENE CHLORIDE RATIO
35% monomer addition
0.48 MRad.

| Substrate | Monomers | % weight increase | % yield | F.E. |
|---|---|---|---|---|
| Pure cotton paper | EA:VC 4:1 | 28.7 | 82 | 4134 |
| | EA:VC 3:2 | 31.3 | 89 | 3392 |
| | EA:VC 1:1 | 31.1 | 89 | 1271 |
| | EA:VC 2:3 | 28.8 | 82 | 50 |
| | EA:VC 1:4 | 5.5 | 16 | — |

EXAMPLE 15—TESTS USING DIFFERENT RADIATION DOSES

(a) Same Source, but Different Periods of Irradiation—Different Total Doses

Samples of a modern mechanical paper were treated, analogously to the general process described, using a 5:1 mixture of ethyl acrylate and methyl methacrylate and 30% total addition at radiation doses of 0.22, 0.45 and 0.6 MRad each, (i.e. approximately a radiation dose rate of $30\times10^3$ Rad $hr^{-1}$ for a period of 7.5, 15 and 22.5 hrs respectively).

The results are shown in Table 22.

TABLE 22

Effect of total radiation dose at constant dose rate on polymer yield

| Substrate | Dose MRad | TREATED % weight increase | TREATED % polymer yield |
|---|---|---|---|
| Book DD | 0.22 | 13.8 | 46 |
| | 0.45 | 20.6 | 69 |
| | 0.6 | 23.2 | 77 |

For a particular dose rate, the yield increased with total dose, and, as will be seen, with this particular sample very good yields were obtained at doses of 0.45 MRad and higher.

A mechanical paper substrate and an aged rag substrate were treated, analogously to the general process described, using a mixture of ethyl acrylate and methyl methacrylate in various proportions and in various total additions at radiation doses of 0.22, 0.45 and in one case 2.4 MRad. The results are shown in Table 23.

TABLE 23

DEPENDENCE OF YIELD ON MONOMER ADDITION FOR SOME AGED SUBSTRATES USING ETHYL ACRYLATE + METHYL METHACRYLATE MIXTURES

| Substrate | Monomer Ratio (w/w) | % Monomer Addition | Dose MRad | % Weight Increase | % Yield |
|---|---|---|---|---|---|
| Book P | 15:1 | 32 | 0.2 | 10.5 | 33 |
| | 15:1 | 32 | 0.4 | 10.4 | 32 |
| | 6:1 | 35 | 0.2 | 13.0 | 37 |
| | 6:1 | 35 | 0.4 | 17.7 | 51 |
| | 6:1 | 35 | 2.4 | 15.6 | 45 |
| | 3:1 | 40 | 0.2 | 17.0 | 42 |
| | 3:1 | 40 | 0.4 | 27.2 | 68 |
| Book DD | 100:1 | 30 | 0.4 | 8.4 | 28 |
| | 5:1 | 30 | 0.4 | 18.0 | 60 |
| | 2:1 | 30 | 0.4 | 13.3 | 44 |
| | 1:1 | 30 | 0.4 | 15.0 | 50 |

(b) Different Sources—Different Dose Rates

Samples of pure cotton paper and esparto-based paper were treated, analogously to the general process described, using a 5:1 mixture of ethyl acrylate and methyl methacrylate and 35% total addition at dose rates of 0.03 and 0.3 MRad/hr; samples were removed at various intervals and the weight increase measured and the yield calculated.

The results are shown in Table 24.

The maximum polymer yield for any given substrate was substantially independent of dose rate. However, the maximum yield at the higher dose rate was achieved at higher total doses of irradiation than at the lower dose rate. For example, for the esparto-based sample, the required dose for maximum yield at a rate of 0.3 MRad $hr^{-1}$ was substantially more than that required at the lower dose rate of 0.03 MRad $hr^{-1}$; nevertheless, the total dose of approximately 0.9 MRad was still below the threshold at which measurable fibre damage occurs.

TABLE 24

EFFECT OF DOSE RATE ON POLYMER YIELD

| SUB-STRATE | TOTAL DOSE (MRad) | DOSE RATE MRad/hr | % WEIGHT INCREASE | % YIELD | |
|---|---|---|---|---|---|
| Pure cotton paper | 0.3 | 0.3 | 21.7 | 62 | |
| | | 0.03 | 34.1 | 97.4 | (max. yield) |
| | 0.4 | 0.3 | 30.9 | 88.3 | (max. yield) |
| | | 0.03 | 34.2 | 97.7 | |
| Esparto-based | 0.3 | 0.3 | 1.8 | 5.1 | |
| | | 0.03 | 13.1 | 37.6 | |
| | 0.45 | 0.3 | 8.9 | 25.4 | |
| | | 0.03 | 22.3 | 63.7 | |
| | 0.9 | 0.3 | 28 | 80 | (max.) |
| | >0.7 | 0.03 | 28.8 | 82.3 | (max.) |

EXAMPLE 16—STRENGTH CONSIDERATIONS—EFFECT OF GLASS TRANSITION TEMPERATURE ON FOLD ENDURANCE

With different monomers and their mixtures the effect of the glass transition temperature ($T_g$) of the polymer product on the ultimate strength of pure cotton paper and newsprint are shown in Table 25.

EXAMPLE 17—TESTS ON THE RELATIONSHIP OF YIELD TO BOILING POINT OF THE MONOMER

Polymerisation was carried out
(a) on pure cotton paper and
(b) on an aged substrate
using
(i) MA,
(ii) EA,
(iii) BA,
(iv) EHA,
(v) BMA,
and on the aged substrate using
(vi) EA+MMA (5:1),
(vii) EA+BMA (5:1),
(viii) EHA+MMA (5:1).
35% monomer addition and 0.45 MRad irradiation were used in each case.

TABLE 25

DEPENDENCE OF FOLD ENDURANCE ON GLASS TRANSITION TEMPERATURE

| Substrate | Monomer(s) | Tg | Fold Endurance |
|---|---|---|---|
| Pure cotton paper | EA:BMA 3:2 | −7 | 6648 |
| | BA only | −56 | 977 |
| | BA:MMA 4:1 | −36 | 1685 |
| | BA:MMA 3:2 | −12 | 4514 |
| | BA:MMA 1:1 | +3 | 3742 |
| | EHA only | −70 | 375 |
| | EHA:MMA 4:1 | −50 | 1502 |
| | EHA:MMA 3:2 | −24 | 4807 |
| | EHA:MMA 1:1 | −9 | 2955 |
| News | BA:MMA 1:1 | +3 | 395 |
| | EHA:MMA 1:1 | −9 | 270 |

Maximum strength is apparently obtained when the polymer formed had a glass transition temperature between about −10° and 0° C.

Figure 1A:
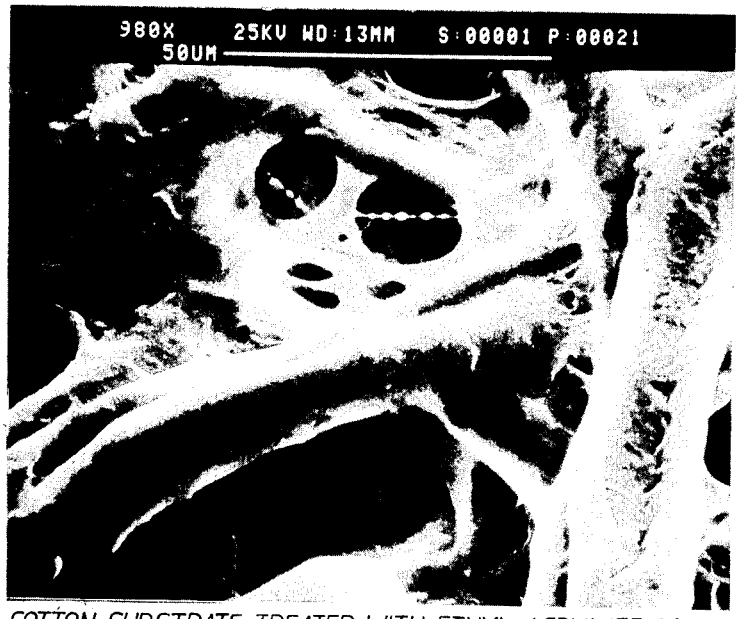
Figure 1B:
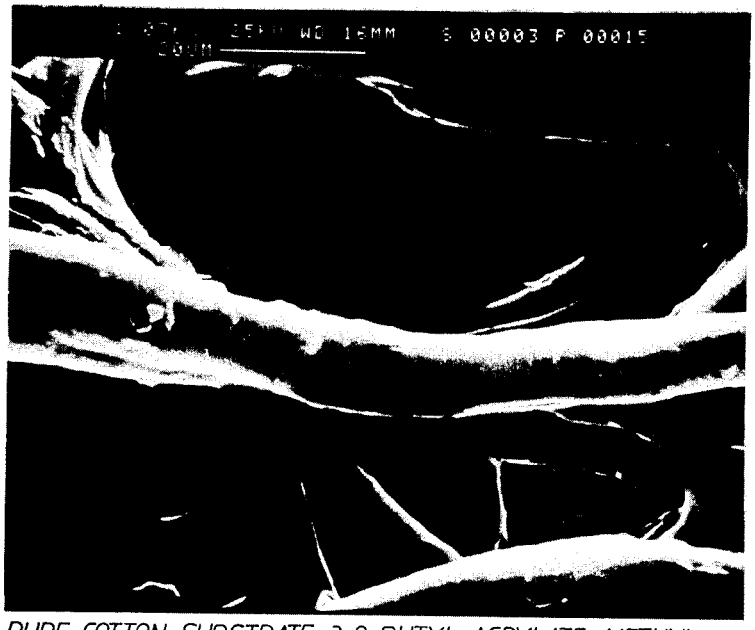
Figure 1C:
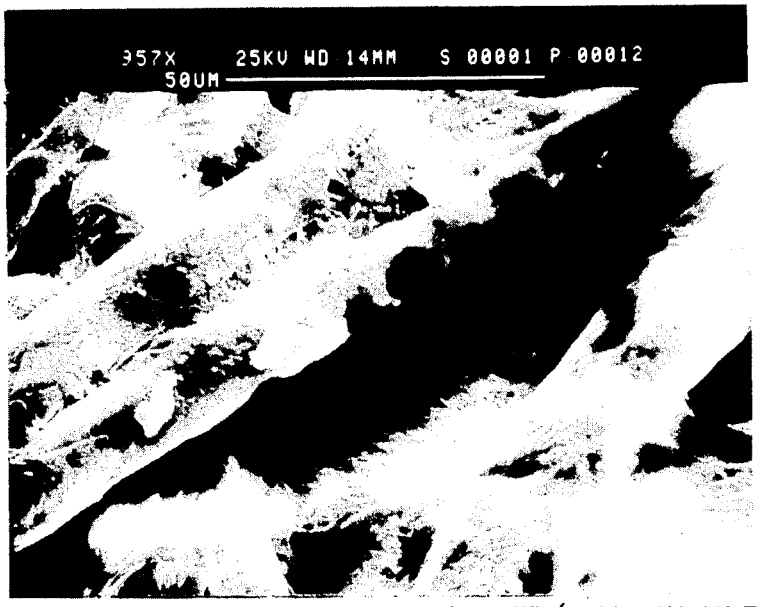
Figure 2:
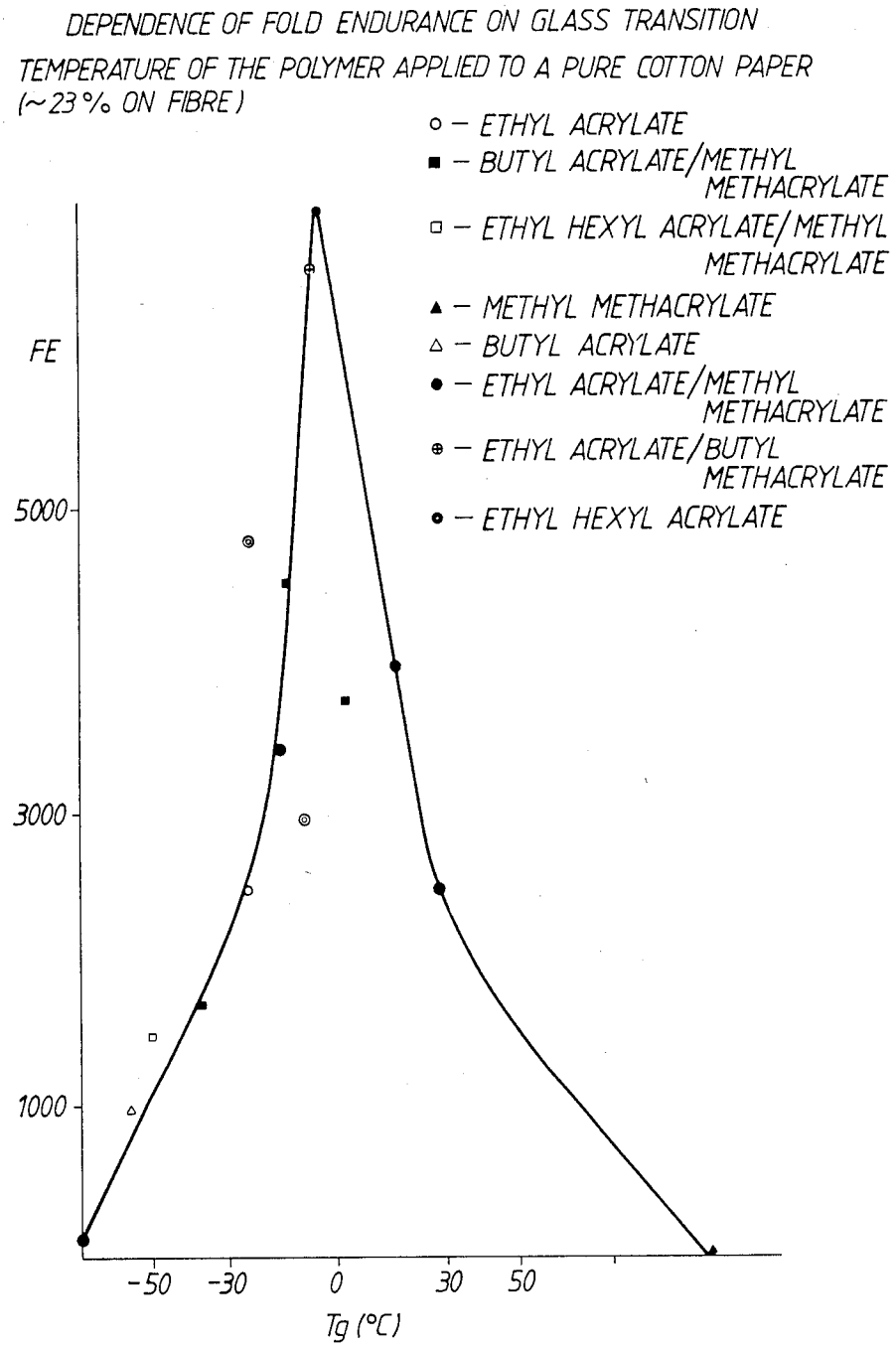
Figure 3:
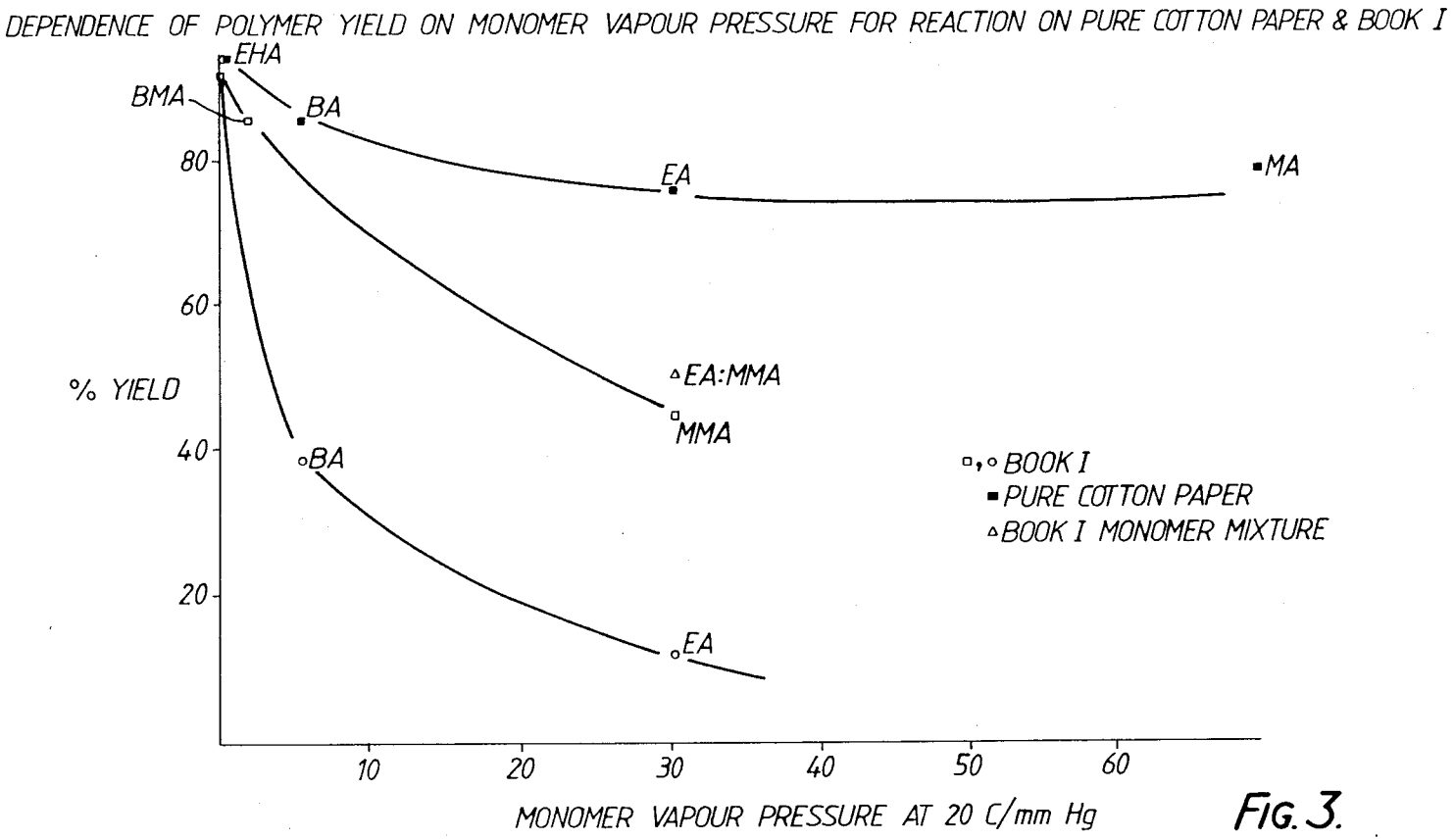
Figure 4:
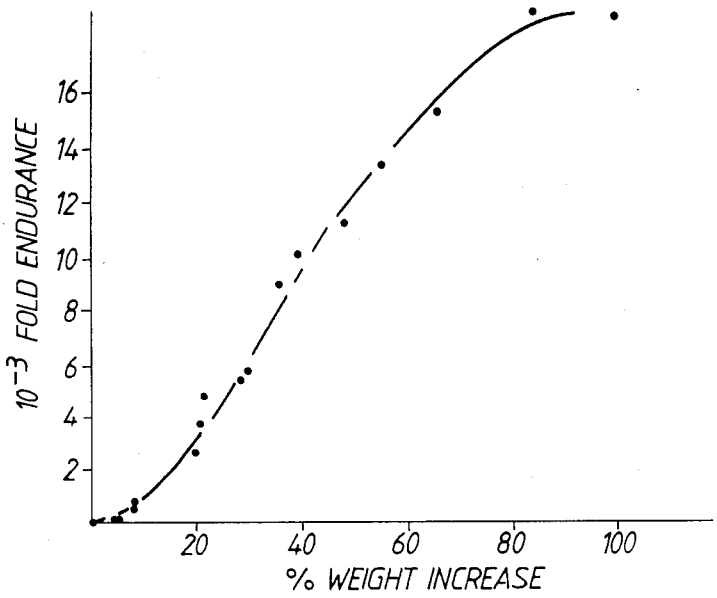
Figure 20:
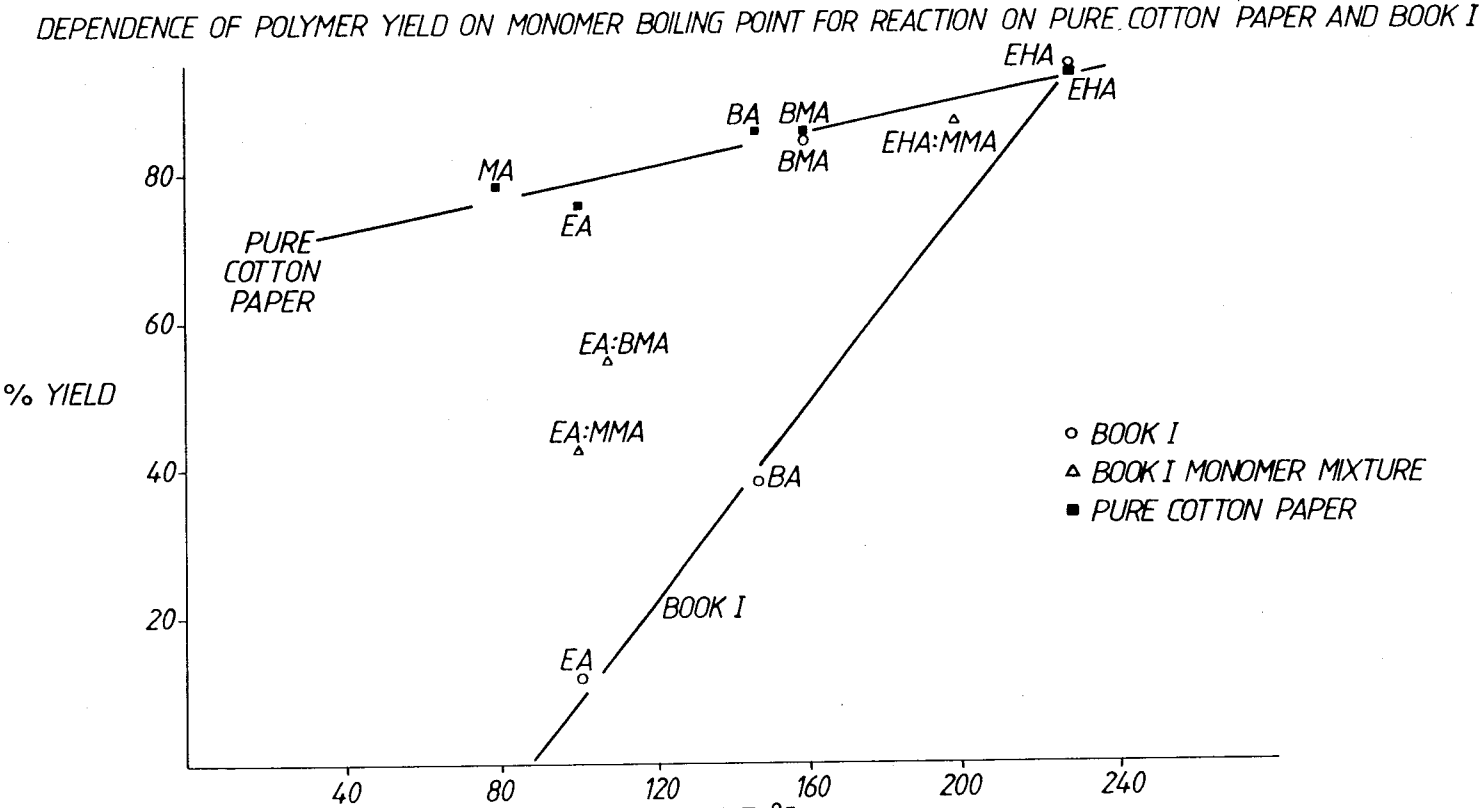

Plots were made of polymer yield v. boiling point and polymer yield v. vapour pressure of monomer or monomer mixture. The results are shown in FIGS. 3 and 20.

Comparing the series of acrylates used, it can be seen that for each substrate the yield increased as the boiling point of the monomer increased and as the vapour pressure decreased. There was an almost linear relationship between acrylate boiling point and yield on the aged substrate. The yields on pure cotton paper with the lower boiling monomers were, as expected, higher than on the aged substrate, and the increase in yield with increased boiling point was less.

With 2-ethylhexyl acrylate the yields were substantially the same on the two substrates. It appears that, with this monomer, polymerisation inhibition, due possibly to the presence of oxygen, had no effect on the yield.

The methacrylate used gave a higher yield on the aged substrate than would be predicted for an acrylate of the same boiling point, and the yield was substantially the same as the yield on pure cotton paper. These facts could, perhaps, be attributable at least in part to a different induction period for the methacrylate as compared with acrylates, and possibly, for a given monomer and given substrate, there is a maximum yield which can be achieved under the particular pressure, temperature and radiation dose conditions used.

Comparing the results obtained using ethyl acrylate and an ethyl acrylate+methyl methacrylate mixture shows the improvement attributable, we believe, solely to the suppression of the inhibition by the monomer mixture (the boiling points of the two monomers being substantially identical). Differences in yields between (i) ethyl acrylate and the EA+BMA mixture
(ii) butyl methacrylate and the EA+BMA mixture
(iii) ethylhexyl acrylate and the EHA+MMA mixture as well as between (iv) EA+MMA and EA+BMA may be due to boiling point (and hence vapour pressure) differences as well as the yield-enhancing effect of the second monomer in the mixture.

EXAMPLE 18—DOUBLE TREATMENT

Ethyl acrylate was applied to a number of substrates in an amount of 30% by weight of the substrate and irradiated at a dose of 0.45 MRad. The percentage weight increase was measured and the yield calculated. The same amount of ethyl acrylate was then added and further irradiation carried out at a dose of 0.15 MRad. For each substrate the increase in weight in comparison with the first treatment, and the percentage yield were found.

The results are given in Table 26.

As will be seen, the second treatment in every case resulted in improved yield. Possibly, in the first treatment, some of the ethyl acrylate acted to exhaust the inhibitor in the substrate.

TABLE 26

Effect of double treatment on overall weight increase

| | 1st treatment | | 2nd treatment | |
|---|---|---|---|---|
| Substrate | % weight inc. | % Yield | % weight inc. | % Yield |
| Book S | 0.9 | 3.0 | 27.4 | 88.3 |
| Book UU | 1.3 | 4.3 | 21.0 | 65.7 |
| Book XX | 0.6 | 2.0 | 22.9 | 74.3 |
| Book WW | 3.5 | 11.7 | 35.0 | 105.0 |
| Book AA | 0.1 | 0.3 | 17.5 | 58.0 |
| Book BB | 2.7 | 9.0 | 33.3 | 102.0 |
| Book DD | 2.9 | 9.7 | 33.1 | 100.7 |
| Book FF | 3.1 | 10.3 | 35.9 | 109.3 |
| Book II | 3.9 | 13.0 | 36.5 | 108.7 |
| Book M | 7.4 | 24.7 | 31.8 | 81.3 |
| Book W | 0.7 | 2.3 | 26.8 | 87.0 |

EXAMPLE 19—TESTS ON A NUMBER OF OTHER MEANS FOR IMPROVING YIELD

Ethyl acrylate polymerisation was attempted on a 1969 British mechanical paper substrate at a dose of 0.45 MRad and a monomer addition of 30% with the following variations:

(i) degassing prior to usual treatment with ethyl acrylate and subsequent irradiation;

(ii) pre-irradiation prior to usual treatment with ethyl acrylate and subsequent irradiation;

(iii) pre-irradiation in the presence of chloroform prior to usual treatment with ethyl acrylate and subsequent irradiation;

(iv) degassing and pre-irradiation prior to usual treatment with ethyl acrylate and subsequent irradiation;

(v) degassing and pre-irradiation in the presence of chloroform prior to usual treatment with ethyl acrylate and subsequent irradiation;

(vi) the usual treatment with ethyl acrylate and irradiation, which is repeated.

The tests were carried out at different doses of radiation in the pre-treatment step.

The doses and results are given in Table 27.

TABLE 27

Treatment of specimens from Book Z by various means

| | % POLYMER YIELDS | |
|---|---|---|
| | CALC ON FIBRE | CALC ON MONOMER |
| DEGASSED* | 7.2 | 24.0 |
| PRE-IRRADIATED WITH 0.22 MRad* | 6.3 | 21.0 |
| PRE-IRRADIATED WITH 0.22 MRad and 5% CHLOROFORM* | 5.4 | 18.0 |
| DEGASSED AND PRE-IRRADIATED WITH 0.22 MRad* | 12.1 | 40.3 |
| DEGASSED, PRE-IRRADIATED WITH 0.22 MRad AND 5% CHLOROFORM* | 14.2 | 47.3 |
| PRE-IRRADIATED WITH 0.45 MRad* | 8.6 | 28.7 |
| PRE-IRRADIATED WITH 0.45 MRad and 5% CHLOROFORM* | 6.0 | 20.0 |
| DEGASSED AND PRE-IRRADIATED WITH 0.45 MRad* | 18.0 | 60.0 |
| DEGASSED, PRE-IRRADIATED WITH 0.45 MRad and 5% CHLOROFORM* | 23.0 | 77.0 |
| PRE-IRRADIATED WITH 0.8 MRad* | 11.0 | 36.7 |
| PRE-IRRADIATED WITH 0.8 MRad and 5% CHLOROFORM* | 14.5 | 48.3 |
| DEGASSED, PRE-IRRADIATED WITH 0.8 MRad AND 5% CHLOROFORM* | 25.3 | 84.3 |
| TREATMENT REPEATED** | 29.6 | 98.7 |

*The samples were pre-treated as indicated, chloroform, when used, being added before pre-irradiation, and then treated with 30% EA at a dose of 0.15 MRad.

**Treatment consisted of 30% EA and irradiation at a dose of 0.45 MRad, and then a further 30% EA and irradiation at 0.45 MRad.

Best yields were obtained with method (iv) at a pre-irradiation dose of 0.45 MRad but not at a pre-irradiation dose of 0.22 MRad, with method (v) at a pre-irradiation dose of 0.45 MRad and higher, but not at a pre-irradiation dose of 0.22 MRad, and with method (vi).

What is claimed is:

1. A process for the treatment of archival material comprising paper, which comprises the radiation-induced polymerisation, within the paper, of a monomer selected from the esters of acrylic acid and esters of α-lower alkyl-substituted acrylic acids or a monomer mixture comprising at least one such monomer, irradiation being carried out in the presence of the monomer or monomers, and the process being caried out in a substantially non-aqueous, substantially solvent-free system.

2. A process as claimed in claim 1, wherein there is used for polymerisation an acrylate monomer of the general formula $$CH_2{=}CH{-}COOR'$$

wherein R' represents a ($C_2$–$C_8$)-alkyl radical.

3. A process as claimed in claim 2, wherein ethyl acrylate is used.

4. A process as claimed in claim 3, wherein an improvement in yield per unit dose of radiation is obtained by:

(i) carrying out polymerisation in the presence of a suitable comonomer, or (ii) carrying out the process repetitiously, irradiation being carried out after the addition of the monomer or monomers in each case.

5. A process as claimed in claim 4, wherein there is used a yield-enhancing monomer of the general formula $$CH_2CR^2{-}COOR''$$

in which R'' represents a ($C_1$–$C_8$)-alkyl radical and $R^2$ represents a methyl group.

6. A process as claimed in claim 3, wherein there is used as comonomer an ester of an αlower-alkyl-substituted acrylic acid of the general formula $$CH_2{=}CCH_3{-}COOR''$$

in which R'' represents a ($C_1$–$C_8$)-alkyl radical.

7. A process as claimed in claim 6, wherein the comonomer is methyl methacrylate.

8. A process as claimed in claim 7, wherein there is used a mixture of ethyl acrylate and methyl methacrylate in a ratio of from 20:1 to 1:1 by weight.

9. A process as claimed in claim 8, wherein the ratio is from 3:1 to 5:1.

10. A process as claimed in claim 1 wherein the vapour pressure of the monomer or monomer mixture at the temperature and pressure of the reaction is such that there is no substantial transfer of monomer from the paper.

11. A process as claimed in claim 1 wherein the monomer or monomer mixture used has a boiling point of at least 130° C. at atmospheric pressure.

12. A process as claimed in claim 11, wherein 2-ethylhexyl acrylate is used.

13. A processor for the treatment of archival material comprising paper, which comprises the radiation-induced polymerisation, within the paper, of a monomer mixture comprising (I) as major component an acrylate monomer of the general formula $$CH_2{=}CH{-}COOR''$$

where R' represents a group of the general formula $C_{n'}H_{2n'+1}$ or $C_{n'}H_{2n'}OH$ in which n' represents an integer from 1 to 10; and (II) as minor component an ester of an α-lower alkyl-substituted acrylic acid of the general formula $$CH_2{=}CR^2{-}COOR''$$

in which R'' represents a group of the general formula $$-C_nH_{2n+1},\ -C_nH_{2n}X,\ -CH_2C_mH_{2m-1} \text{ or } -CH_2C_mH_{2m-3}$$

in which n represents an integer from 1 to 16,

X represents OH, a halogen atom or an unsubstituted or mono- or di-lower alkyl-substituted amino group, and m represents an integer from 2 to 15, and $R^2$ represents a lower alkyl radical, irradiation being carried out in the presence of the monomer or monomers, and the process being carried out in a substantially non-aqueous substantially solvent-free system and with the avoidance of saturation of the archival material.

14. A process as claimed as claimed in claim 13, wherein there is used a mixture of ethyl acrylate and methyl or butyl methacrylate and the glass transition temperature of the resulting polymer is in the range of from −20° to +20° C.

15. A process for the treatment of archival material comprising paper, which comprises the radiation-induced polymerisation, within the paper, of (i) a monomer selected from the esters of acrylic acid and the esters of α-lower alkyl-substituted acrylic acids and (ii) a comonomer which provides an improvement in yield per unit dose of radiation and which is selected from the esters of acrylic acid and esters of α-lower alkyl-substituted acrylic acids, irradiation being carried out in the presence of the monomers, and the process being carried out with substantially no swelling of the fibres of the paper of the archival material.

16. A process for the treatment of archival material comprising paper, which comprises the radiation-induced polymerisation, within the paper, of a monomer selected from the esters of acrylic acid and α-lower alkyl-substituted acrylic acids or a monomer mixture comprising at least one such monomer, wherein repeated treatment is used, irradiation being carried out after the addition of the monomer or monomers in each case, and the process being carried out with substantially no swelling of the fibres of the paper of the archival material.

17. A process for the treatment of archival material, comprising paper, which comprises the radiation-induced polymerisation, within the paper, of a monomer selected from the esters of acrylic acid and the esters of α-lower alkyl-substituted acrylic acids or a monomer mixture comprising at least one such monomer, irradiation being carried out after the addition of the monomer or monomers, and wherein the vapour pressure of the monomer or monomer mixture at the temperature and pressure of the reaction is such that there such that there is no substantial transfer from the paper and process is carried out with substantially no swelling of the fibres of the paper of the archival material.

18. A process for the treatment of archival material comprising paper, which comprises the radiation-induced polymerisation, within the paper, of an ester of acrylic acid or a monomer mixture comprising an ester of acrylic acid and an ester of an α-lower alkyl-substituted acrylic acid, irradiation being carried out in the presence of the monomer or monomers, and the process being carried out with minimum swelling of the fibres of the paper of the archival material.

19. A process for the treatment of archival material comprising paper, which comprises the radiation-induced polymerisation, with the paper, of a monomer selected from the esters of acrylic acid and α-lower alkyl-substituted acrylic acids or a monomer mixture comprising at least one such monomer, irradiation being carried out in the presence of the monomer or monomers, and the process being carried out in a substantially non-aqueous system, the monomer or monomers being applied in bulk form by a non-immersion process in an amount of up to 50% by weight of the archival material.

20. A process as claimed in claim 19, wherein there is used a monomer mixture of an acrylate and a methacrylate.

21. A process as claimed in claim 20, wherein the glass transition temperature of the resulting polymer is in the range of from −20° to +20° C.

22. A process as claimed in claim 21, wherein there is used a mixture of ethyl acrylate and methyl methacrylate in a ratio of from 20:1 to 1:1 by weight.

23. A process as claimed in claim 22, wherein the ratio is from 3:1 to 5:1.

24. A process as claimed in claim 19, wherein repeated treatment is used, irradiation being carried out after the addition of the monomer or monomers in each case.

25. A process as claimed in claim 19, wherein the vapour pressure of the monomer or monomer mixture at the temperature and pressure of the reaction is such that there is no substantial transfer of monomer from the paper.

26. A process as claimed in claim 19, wherein the monomer or monomer mixture used has a boiling point of at least 130° C. at atmospheric pressure.

27. A process as claimed in claim 26, wherein 2-ethylhexyl acrylate is used.

28. A process for the treatment of archival material comprising paper, which comprises the radiation-induced polymerisation, within the paper, of a monomer mixture comprising ethyl acrylate and methyl methacrylate in a ratio of from 3:1 to 5:1 by weight, irradiation being carried out in the presence of the monomers and the process being carried out in a substantially non-aqueous substantially solvent-free system and the monomers being applied by a non-immersion process in an amount of up to 50% by weight of the archival material.

29. A process as claimed in claim 28, wherein the polymerisation system contains α-(dimethylamino)ethyl methacrylate.

30. A process as claimed in claim 1, wherein the glass transition temperature of the resulting polymer is in the range of from −20° to +20° C.

31. A process as claimed in claim 1, wherein the archival material comprises one or more bound volumes.

32. A process as claimed in claim 1, wherein the polymerisation system contains an amine-substituted alkyl methacrylate monomer.

33. A process as claimed in claim 1 wherein the polymerisation system contains a basic monomer.

34. A process as claimed in claim 33, wherein the basic monomer is an amine-substituted alkyl methacrylate.

35. A process as claimed in claim 34, wherein the methacrylate is α-(dimethylamino-ethyl methacrylate.

36. A process as claimed in any one of claims 1, 13 or 28 wherein the monomer or monomers are condensed within the paper from the vapour phase.

37. A process as claimed in any one of claims 1, 13 or 28 wherein the glass transition temperature of the resulting polymer is in the range from 0° to −10° C.

38. A process as claimed in any one of claims 1, 13 or 28 wherein the archival material comprises one or more entire books.

39. A process as claimed in any one of claims 1, 13 or 28 wherein the archival material comprises one or more bound volumes of newspapers and/or magazines.

40. A process as claimed in any one of claims 1, 13 or 28 wherein the fold endurance of the paper to be treated is at least 15.

41. A process as claimed in any one of claims 1, 13 or 28 wherein the total monomer addition is from 15 to 50% of the weight of the archival material.

42. A process as claimed in any one of claims 1, 13 or 28 wherein the total monomer addition is from 15 to 25% of the weight of the archival material.

43. A process as claimed in any one of claims 1, 13 or 28 wherein the total monomer addition is substantially 20% of the weight of the archival material.

44. A process as claimed in any one of claims 1, 13 or 28 wherein the or each irradiation step uses a dose of at least 0.2 MRad.

45. A process as claimed in any one of claims 1, 13 or 28 wherein the or each irradiation step uses a dose of at least 0.4 MRad.

46. A process as claimed in any one of claims 1, 13 or 28 wherein the increase in weight of the paper is at least 10%.

47. A process as claimed in any one of claims 1, 13 or 28 wherein the polymerisation yield is at least 60%.

* * * * *